US009335003B2

(12) United States Patent
Shin et al.

(10) Patent No.: US 9,335,003 B2
(45) Date of Patent: May 10, 2016

(54) CARGO TANK FOR EXTREMELY LOW TEMPERATURE SUBSTANCE CARRIER

(71) Applicant: HYUNDAI HEAVY INDUSTRIES CO., LTD., Ulsan (KR)

(72) Inventors: Sang Beom Shin, Ulsan (KR); Hyun Soo Kim, Ulsan (KR); Hyung Kook Jin, Ulsan (KR); Dong Ju Lee, Ulsan (KR); Ha Geun Kim, Ulsan (KR); In Wan Park, Ulsan (KR); Byeong Jae Noh, Ulsan (KR); Joong Geun Youn, Ulsan (KR); Dae Soon Kim, Ulsan (KR)

(73) Assignee: HYUNDAI HEAVY INDUSTRIES CO., LTD., Dong-gu, Ulsan (KR)

( * ) Notice: Subject to any disclaimer, the term of this patent is extended or adjusted under 35 U.S.C. 154(b) by 98 days.

(21) Appl. No.: 14/245,441

(22) Filed: Apr. 4, 2014

(65) Prior Publication Data

US 2014/0299038 A1 Oct. 9, 2014

Related U.S. Application Data

(60) Provisional application No. 61/808,845, filed on Apr. 5, 2013.

(30) Foreign Application Priority Data

Apr. 9, 2013 (KR) ..... 10-2013-0038768

(51) Int. Cl.

| | |
|---|---|
| ***F17C 13/00*** | (2006.01) |
| ***F17C 1/00*** | (2006.01) |
| ***B63B 25/16*** | (2006.01) |

(52) U.S. Cl.

CPC ..... *F17C 13/001* (2013.01); *B63B 25/16* (2013.01); *F17C 1/002* (2013.01);

(Continued)

(58) Field of Classification Search

CPC ..... F17C 1/002; F17C 13/001; F17C 2207/0107; F17C 2203/0358; F17C 2203/0626; F17C 2203/345; F17C 2203/0631; F17C 2203/0624; F17C 2203/0333; B65D 81/18

USPC ..... 220/901, 560.4–560.15, 562, 592.2, 220/592.26

See application file for complete search history.

(56) References Cited

U.S. PATENT DOCUMENTS 3,208,621 A * 9/1965 Dawson ..... F17C 13/001 220/560.13
3,246,789 A * 4/1966 Progler ..... F17C 3/025 220/560.11

(Continued)

FOREIGN PATENT DOCUMENTS

JP 2007-125745 A 5/2007
JP 2007-525624 A 9/2007

(Continued)

OTHER PUBLICATIONS

International Search Report dated Feb. 7, 2014; PCT/KR2014/002898.

*Primary Examiner* — Jeffrey Allen
*Assistant Examiner* — Jennifer Castriotta
(74) *Attorney, Agent, or Firm* — Ladas & Parry LLP

(57) ABSTRACT

A cargo tank for an extremely low temperature substance carrier according to the present invention arranges a first cargo tank wall having a primary corrugated panel to prevent cracks caused by contraction and easily absorb impact caused by liquefied gas sloshing to prevent defects occurring in the cargo tank, forms auxiliary corrugation on each of the first, second and third cargo tank walls to prevent defects caused by contraction and more easily absorb impact caused by liquefied gas sloshing, and selectively applies the first to third cargo tank walls having different structures to respective parts of the cargo tank where different sloshing phenomena occur to improve reliability of the cargo tank.

13 Claims, 20 Drawing Sheets

(52) U.S. Cl.
CPC ..... *F17C 2203/0333* (2013.01); *F17C 2203/0354* (2013.01); *F17C 2203/0651* (2013.01); *F17C 2203/0663* (2013.01); *F17C 2209/221* (2013.01); *F17C 2209/232* (2013.01); *F17C 2221/033* (2013.01); *F17C 2221/035* (2013.01); *F17C 2223/0153* (2013.01); *F17C 2223/0161* (2013.01); *F17C 2260/016* (2013.01); *F17C 2270/0105* (2013.01); *F17C 2270/0107* (2013.01)

(56) References Cited

U.S. PATENT DOCUMENTS

| | | | | | |
|---|---|---|---|---|---|
| 3,397,720 | A * | 8/1968 | Jones | F16L 59/029 | 138/149 |
| 3,952,777 | A * | 4/1976 | Uhlig | F16L 59/12 | 138/113 |
| 5,246,759 | A * | 9/1993 | Keller | F16L 59/08 | 220/592.21 |
| 2005/0082297 | A1 | 4/2005 | Dhellemmes | | |
| 2007/0289974 | A1 * | 12/2007 | Blair | F17C 13/001 | 220/560.15 |

FOREIGN PATENT DOCUMENTS

| | | | |
|---|---|---|---|
| KR | 100799449 | B1 | 1/2008 |
| KR | 1020110136431 | A | 12/2011 |
| KR | 1020120013226 | A | 2/2012 |
| KR | 10-1131536 | B1 | 3/2012 |
| KR | 1020120039861 | A | 4/2012 |
| KR | 10-1144397 | B1 | 5/2012 |
| KR | 1020120074441 | A | 7/2012 |
| KR | 10-1215473 | B1 | 12/2012 |
| KR | 10-1224930 | B1 | 1/2013 |
| KR | 1020130033470 | A | 4/2013 |
| KR | 1020140121331 | A | 10/2014 |
| KR | 1020140121332 | A | 10/2014 |
| KR | 1020140121333 | A | 10/2014 |
| KR | 1020140121334 | A | 10/2014 |
| KR | 1020140121335 | A | 10/2014 |
| KR | 1020140121336 | A | 10/2014 |
| KR | 1020140121340 | A | 10/2014 |

* cited by examiner

CARGO TANK FOR EXTREMELY LOW TEMPERATURE SUBSTANCE CARRIER

CROSS-REFERENCE TO RELATED APPLICATION

The present application claims benefit under 35 U.S.C. §119(e) of U.S. Provisional Application No. 61/808,845 filed on Apr. 5, 2013 in the United States Patent and Trademark Office, and benefit under 35 U.S.C. §119(a) of Korean patent application number 10-2013-0038768 filed on Apr. 9, 2013 in the Korean Intellectual Property Office, the entire disclosure of which are incorporated by reference herein.

BACKGROUND

An embodiment relates generally to a cargo tank for an extremely low temperature substance carrier.

RELATED ART

A cargo tank for a carrier storing and carrying extremely low temperature (including low temperature and ultra low temperature) liquefied gas, such as LNG or LPG, is to maintain the liquefied gas, which is insulated from the outside, in a desired state and have durability against loads and chemical reactions of the liquefied gas.

As an insulation structure of an extremely low temperature cargo tank, membrane insulation material systems, such as "Mark III" and "NO 96," manufactured by Gaztransport & Technigaz S.A.s (GTT) in France, are widely known.

A "Mark III" type cargo tank includes a primary barrier formed of a stainless steel membrane corrugation barrier (or corrugated barrier) and a secondary barrier made of a triplex composite. In addition, a primary insulated wall is provided between the primary and secondary barriers, and a secondary insulated wall is provided between the secondary barrier and the hull. The primary insulated wall is formed by bonding a plywood board to a top surface of an insulation material made of polyurethane foam (PUF) having a density of approximately 130 kg/m$^3$. The secondary insulated wall is formed by bonding a plywood board to a bottom surface of an insulation material made of polyurethane foam (PUF) which is the same as that of the primary insulated wall. The secondary insulated wall is supported by the hull by using mastic and fixed to the hull by stud bolts.

It is relatively easy to construct the above-described "Mark III" type cargo tank since the primary barrier, the secondary barrier, the primary insulated wall and the secondary insulated wall are separately manufactured and united on land and then mounted. However, since welding the corrugated barrier, i.e., the primary barrier is complicated, the rate of automation is low, and it is also relatively difficult to ensure the reliability of the secondary barrier formed of triplex.

In addition, since "Mark II" type cargo tanks have excellent insulation properties, insulated walls thereof may have a smaller thickness than that insulated walls of "NO 96" type cargo tanks, so that an internal volume of the cargo tank may be increased. However, since there is always a possibility that leakage may occur in the secondary barrier bonded between the primary and secondary insulated walls by an adhesive, enormous time and cost may be consumed in order to prevent leakage. Further, it is highly unlikely to solve such problems.

A "NO 96" cargo tank includes primary and secondary barriers using membrane sheets formed of invar which is called "invariable steel". In addition, primary and secondary insulated walls are formed by filling insulation boxes made of wood with pearlite powder and connecting the insulation boxes by couplers.

Since the primary and secondary barriers of the above "NO 96" type cargo tank are flat panel types without corrugations, welding may be easily performed as compared to the "Mark III" type cargo tank. Thus, automation of barrier welding may be relatively easy. However, since the primary and secondary insulated walls need to be provided in the shape of a box, it may be more difficult to construct the "NO 96" type cargo tank than the "Mark III" type cargo tank.

In addition, since membranes made of high-value invar are used to form the primary and secondary barriers of the above "NO 96" type cargo tank, material cost may be higher than that of the "Mark III" type cargo tank.

In addition, since the insulated wall of the "NO 96" type cargo tank is formed by filling the box made of wood with pearlite powder which is an insulation material, the primary and secondary barriers of the above "NO 96" type cargo tank may have higher compressive strength and rigidity than the "Mark III" type cargo tank. At the same time, however, since the thickness of the box made of wood is increased, thermal conduction of the "NO 96" type cargo tank may be increased as compared to the "Mark III" type cargo tank" to deteriorate insulation performance. As a result, the thickness of the insulated wall needs to be increased and therefore the internal volume of the cargo tank may be reduced. In addition, the box made of wood may be damaged by sloshing of the liquefied gas in the cargo tank.

SUMMARY OF THE INVENTION

Various embodiments relate to a cargo tank for an extremely low temperature substance carrier capable of increasing reliability of the cargo tank by selectively applying first to third cargo tank walls having different structures to respective parts of the cargo tank where different liquefied gas sloshing phenomena occur.

Another embodiment of the present invention provides a cargo tank for an extremely low temperature substance carrier capable of separately manufacturing and mounting the cargo tank and reducing construction duration by forming a first cargo tank wall including a barrier where a curved type and a flat type are integrated at a side corner line of the cargo tank and bonding a second or third cargo tank wall having a flat type barrier to the first cargo tank wall at other parts of the cargo tank.

Another embodiment of the present invention provides a cargo tank for an extremely low temperature substance carrier capable of reducing the impact caused by liquefied gas sloshing by forming auxiliary corrugations on primary barriers of the first to third cargo tank walls.

Another embodiment of the present invention provides a cargo tank for an extremely low temperature substance carrier capable of improving bonding strength of a barrier by forming a tongue for connecting unit panels of a flat type primary barrier into a double structure.

Another embodiment of the present invention provides a cargo tank for an extremely low temperature substance carrier capable of reducing manufacturing costs by forming a membrane sheet forming a curved portion and a flat portion of a barrier with different types of materials.

A cargo tank for an extremely low temperature substance carrier according to an aspect of the present invention may include a primary barrier including a primary corrugated panel having a corrugated portion formed by a plurality of continuous corrugated cross-sections and a primary main panel connected to the primary corrugated panel, a secondary barrier including a secondary corrugated panel having a corrugated portion formed by a plurality of continuous corrugated cross-sections and a secondary main panel connected to the secondary corrugated panel, a primary insulated wall provided between the primary barrier and the secondary barrier and including a depression receiving the corrugated portion of the secondary corrugated panel, and a secondary insulated wall provided between the secondary barrier and a body shell.

The primary insulated wall may include an upper plywood board provided under the primary barrier, an upper glass fiber reinforced epoxy composite provided under the upper plywood board, a lower glass fiber reinforced epoxy composite provided on the secondary barrier, and an insulation plate provided between the upper glass fiber reinforced epoxy composite and the lower glass fiber reinforced epoxy composite.

The insulation plate may include an insulation material formed of high-density polyurethane foam having a density of 200 kg/m$^3$ or more.

The upper glass fiber reinforced epoxy composite may be a flat panel, and the lower glass fiber reinforced epoxy composite may be a flat panel having the depression formed therein.

The depression may have a trapezoidal cross-section and a depth greater than height and width of the corrugated portion of the secondary corrugated panel.

The secondary insulated wall may include an upper plywood board provided under the secondary barrier, a lower plywood board provided on the body shell, and an insulation plate provided between the upper plywood board and the lower plywood board.

The insulation plate may include an insulation material formed of high-density polyurethane foam having a density of 200 kg/m$^3$ or more.

Each of the primary corrugated panel and the secondary corrugated panel may include a corner piece extending from the corrugated portion.

Each of the primary corrugated panel and the secondary corrugated panel may include invar or stainless steel.

Each of the primary main panel and the secondary main panel may be formed by connecting a plurality of insert panels including flanges, a distance between the flanges provided on the plurality of insert panels of the primary main panel may be smaller than a distance between the flanges provided on the insert panels of the secondary main panel, and the flanges of the primary main panel and the flanges of the secondary main panel may be arranged alternately with each other.

Each of the primary main panel and the secondary main panel may include invar or stainless steel.

The corrugated portion of each of the primary corrugated panel and the secondary corrugated panel may include a plurality of parallel, continuous corrugated cross-sections formed along a corner line of the cargo tank, and corrugations of the corrugated portion of the secondary corrugated panel may have a smaller depth and a greater pitch than corrugations of the corrugated portion of the primary corrugated panel.

The corrugated portion may absorb contraction deformation caused by temperature of an extremely low temperature substance and absorb sloshing impact exerted on a corner line during liquefied gas sloshing.

DETAILED DESCRIPTION

Figure 1:
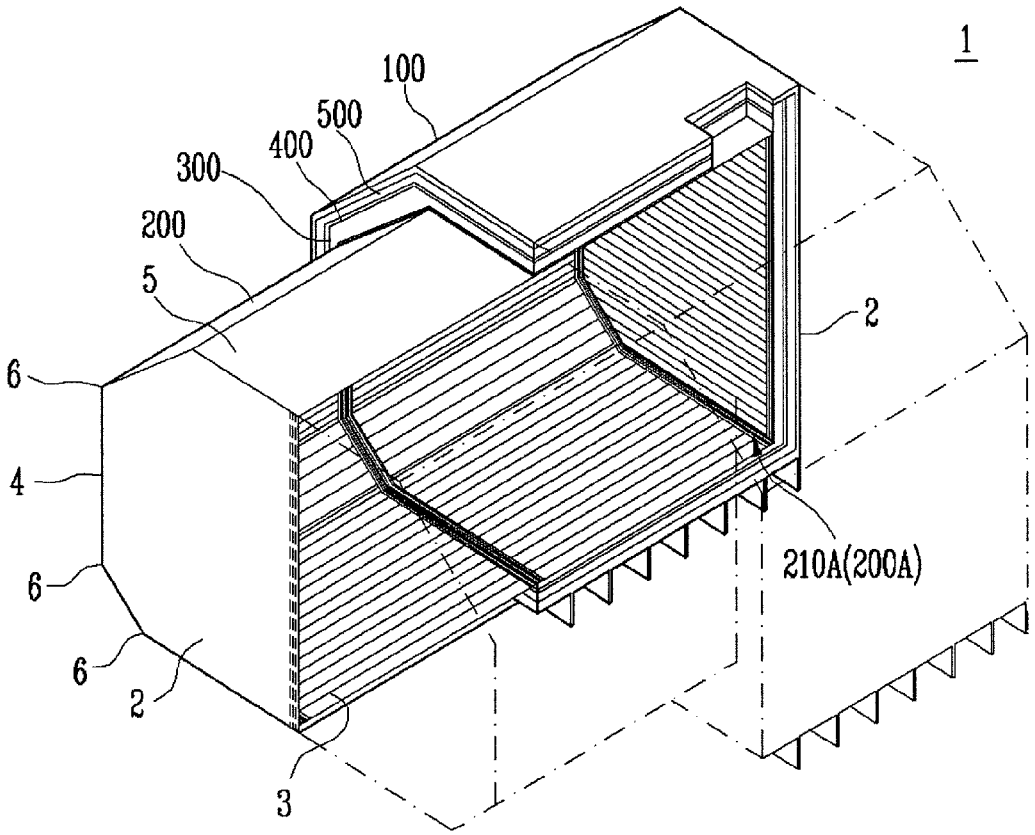
FIG. 1 is a schematic diagram illustrating a cargo tank for an extremely low temperature substance carrier according to an embodiment of the present invention.

Hereinafter, various embodiments of the present disclosure will be described in detail with reference to the accompanying drawings. The drawings are not necessarily to scale and in some instances, proportions may have been exaggerated in order to clearly illustrate features of the embodiments. Moreover, detailed descriptions related to well-known functions or configurations will be ruled out in order not to unnecessarily obscure subject matters of the present invention. Like reference numerals in the drawings denote like elements.

FIG. 1 is a schematic view illustrating a cargo tank for an extremely low temperature substance carrier according to an embodiment of the present invention. FIG. 1 is a view for defining the entire shape and directions of a cargo tank 1 for an extremely low temperature substance carrier throughout the specification, rather than describing respective components in detail. However, since the directions of the cargo tank 1 are arbitrarily designated, these directions given in the specification may be different from those applied to the actual ship.

In addition, an "inside" refers to a direction of an internal receiving space of the cargo tank 1 and an "outside" refers to a direction of a hull shell 100 on the outside the cargo tank 1.

As illustrated in FIG. 1, the cargo tank 1 according to an embodiment may include a hull shell 100 forming the outside of the cargo tank 1, a membrane primary barrier 200 contacting an extremely low temperature substance in the cargo tank 1, a primary insulated wall 300 provided outside the primary barrier 200, a membrane secondary barrier 400 provided outside the primary insulated wall 300, and a secondary insulated wall 500 provided outside the secondary barrier 400 and fixed to the hull shell 100. Side walls 2 may be formed in a front-back direction of these components (100, 200, 300, 400 and 500). A floor 3, a vertical wall 4 and a ceiling 5 may be formed between the side walls 2. A corner line 6 defined by the side wall 2, the floor 3, the vertical wall 4 and the ceiling 5 meeting each other may have obtuse angles or right angles.

The secondary insulated wall 500 of the cargo tank 1 may be fixed to the hull shell 100 by a plurality of stud bolts or anchors (not shown) or may be engaged by a spring and bolt assembly (not shown).

The cargo tank 1 may include one of a first cargo tank wall A to be described below, a second cargo tank wall B to be described below and a third cargo tank wall C to be described below, or a combination thereof.

Therefore, the primary barrier 200 of the cargo tank 1 may include one of a primary barrier 200A of the first cargo tank wall A to be described below, a primary barrier 200B of the second cargo tank wall B to be described below and a primary barrier 200C of the third cargo tank wall C to be described below, or a combination thereof.

Therefore, the primary insulated wall 300 of the cargo tank 1 may include one of a primary insulated wall 300A of the first cargo tank wall A to be described below, a primary insulated wall 300B of the second cargo tank wall B to be described below and a primary insulated wall 300C of the third cargo tank wall C to be described below, or a combination thereof.

In addition, the secondary barrier 400 of the cargo tank 1 may include one of a secondary barrier 400A of the first cargo tank wall A to be described below, a secondary barrier 400B of the second cargo tank wall B to be described below and a secondary barrier 400C of the third cargo tank wall C to be described below, or the combination thereof.

Therefore, the secondary insulated wall 500 of the cargo tank 1 may include one of a secondary insulated wall 500A of the first cargo tank wall A to be described below, a secondary insulated wall 500B of the second cargo tank wall B to be described below and a secondary insulated wall 500C of the third cargo tank wall C to be described below, or a combination thereof.

Hereinafter, the first cargo tank wall A, the second cargo tank wall B and the third cargo tank wall C is described below with reference to the accompanying drawings.

Figure 2:
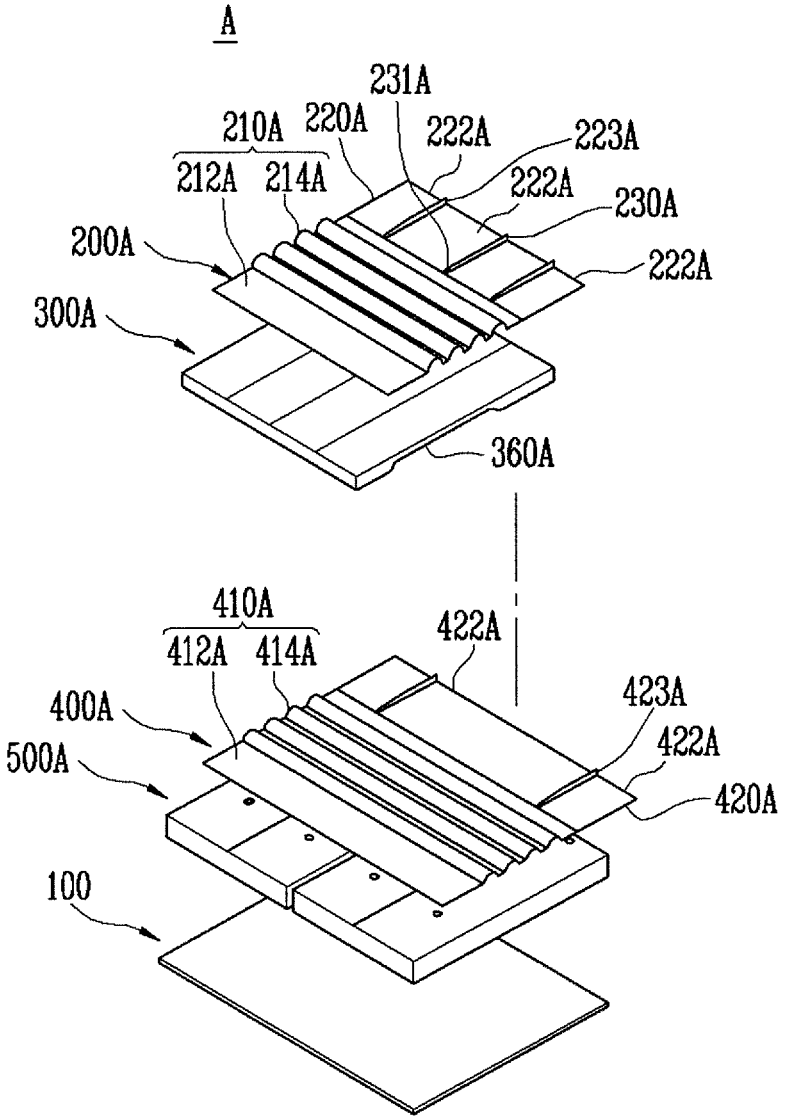
FIG. 2 is an exploded perspective view illustrating a first cargo tank wall according to an embodiment of the present invention.
Figure 3:
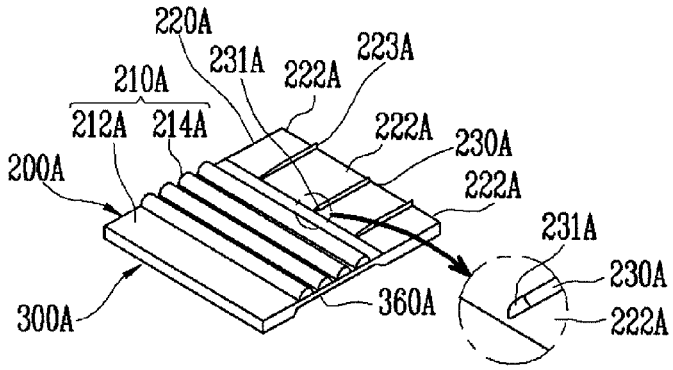
FIG. 3 is an assembled perspective view illustrating a primary barrier and a primary insulated wall of a first cargo tank wall according to an embodiment of the present invention.
Figure 4:
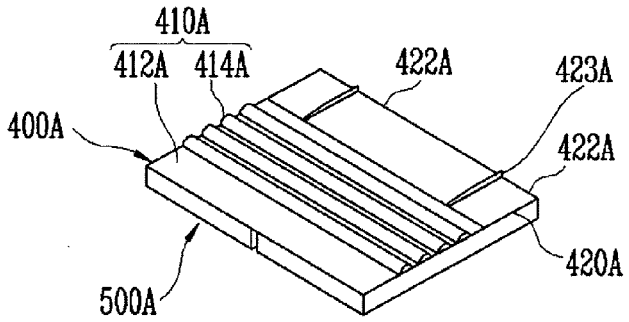
FIG. 4 is an assembled perspective view illustrating a secondary barrier and a secondary insulated wall of a first cargo tank wall according to an embodiment of the present invention.
Figure 5:
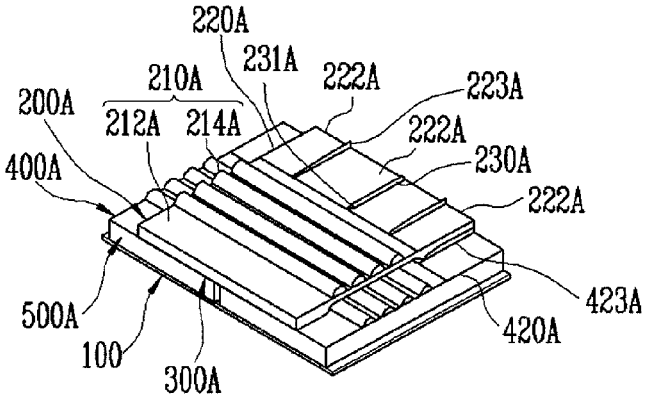
FIG. 5 is a assembled perspective view illustrating a primary barrier, a primary insulated wall, a secondary barrier and a secondary insulated wall of a first cargo tank wall according to an embodiment of the present invention.
Figure 6:
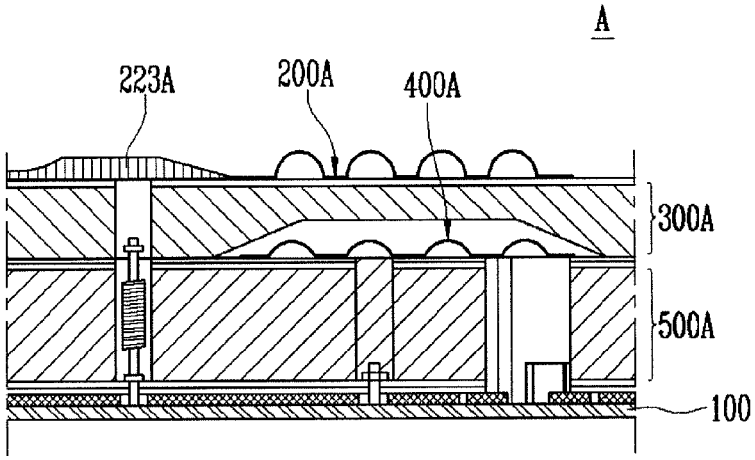
FIG. 6 is a partial cross-sectional view illustrating a first cargo tank wall according to an embodiment of the present invention.
Figure 7:
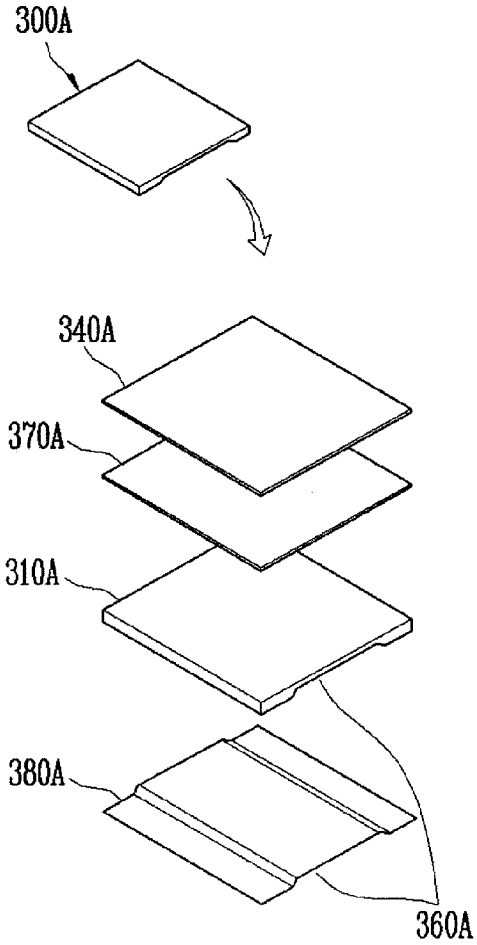
FIG. 7 is an exploded perspective view illustrating a primary insulated wall of a first cargo tank wall according to an embodiment of the present invention.
Figure 8:
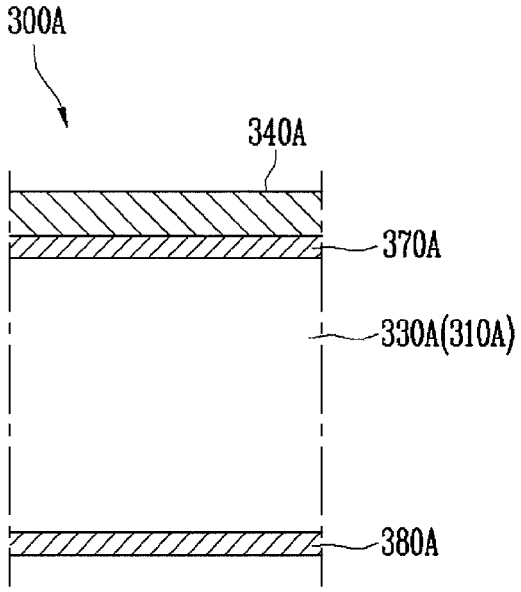
FIG. 8 is a partial cross-sectional view illustrating a primary insulated wall of a first cargo tank wall according to an embodiment of the present invention.
Figure 9:
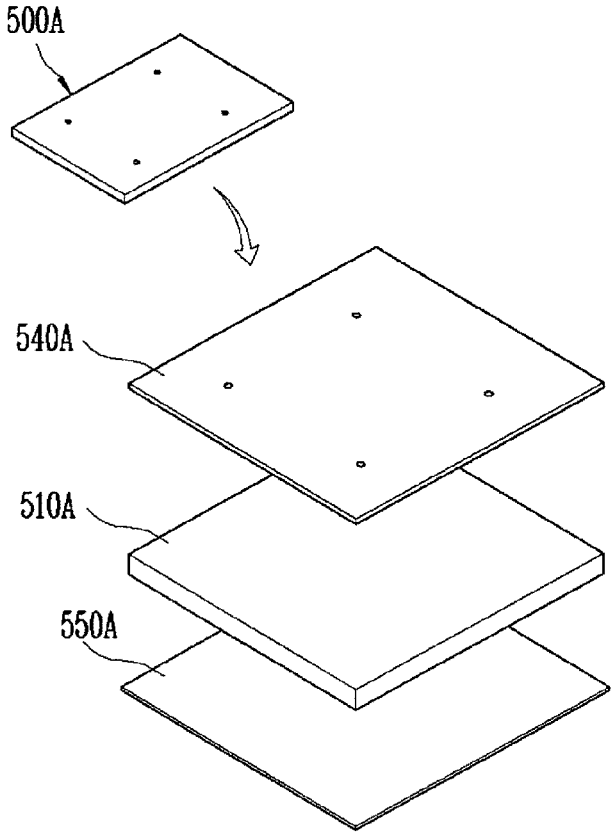
FIG. 9 is an exploded perspective view illustrating a secondary insulated wall of a first cargo tank wall according to an embodiment of the present invention.
Figure 10:
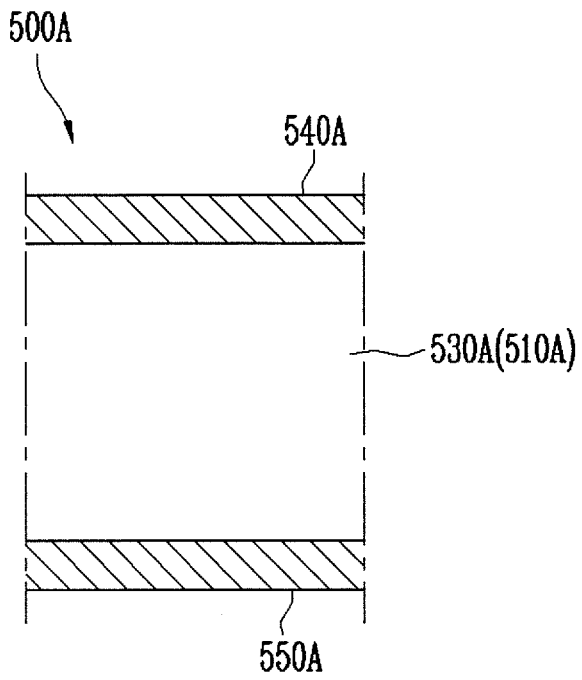
FIG. 10 is a partial cross-sectional view illustrating a secondary insulated wall of a first cargo tank wall according to an embodiment of the present invention.
Figure 31:
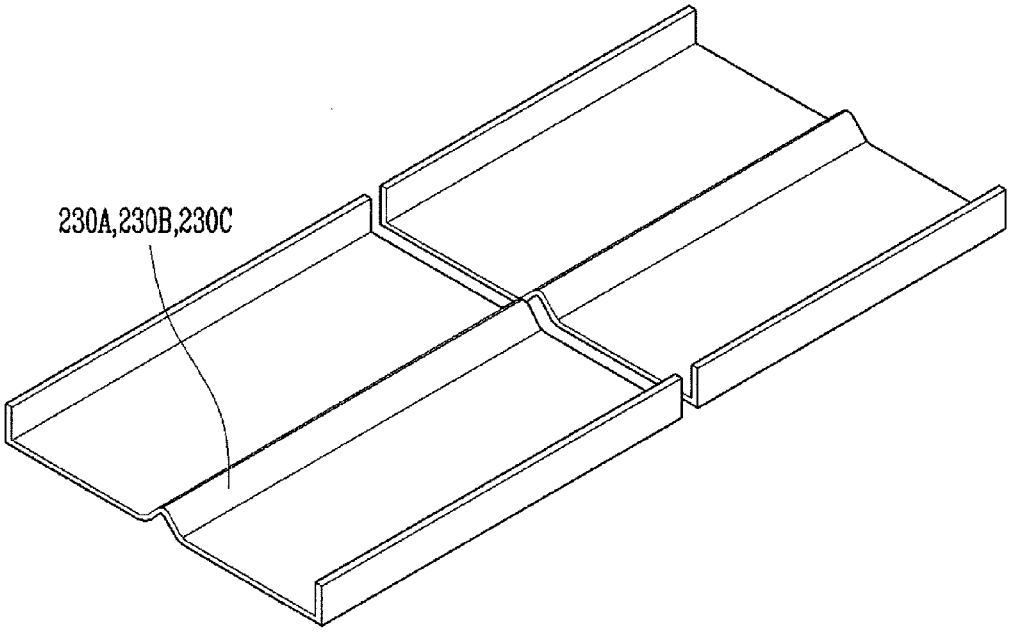
FIG. 31 is an enlarged view illustrating auxiliary corrugation according to an embodiment of the present invention.

FIG. 2 is an exploded perspective view illustrating a first cargo tank wall according to an embodiment of the present invention. FIG. 3 is an assembled perspective view illustrating a primary barrier and a primary insulated wall of a first cargo tank wall according to an embodiment of the present invention. FIG. 4 is an assembled perspective view illustrating a secondary barrier and a secondary insulated wall of a first cargo tank wall according to an embodiment of the present invention. FIG. 5 is an assembled perspective view illustrating a primary barrier, a primary insulated wall, a secondary barrier and a secondary insulated wall of a first cargo tank wall according to an embodiment of the present invention. FIG. 6 is a partial cross-sectional view illustrating a first cargo tank wall according to an embodiment of the present invention. FIG. 7 is an exploded perspective view illustrating a primary insulated wall of a first cargo tank wall according to an embodiment of the present invention. FIG. 8 is a partial cross-sectional view illustrating a primary insulated wall of a first cargo tank wall according to an embodiment of the present invention. FIG. 9 is an exploded perspective view illustrating a secondary insulated wall of a first cargo tank wall according to an embodiment of the present invention. FIG. 10 is a partial cross-sectional view illustrating a secondary insulated wall of a first cargo tank wall according to an embodiment of the present invention. FIG. 31 is an enlarged view illustrating auxiliary corrugation according to an embodiment of the present invention.

As illustrated in FIGS. 2 to 10, the first cargo tank wall A may include the hull shell 100 forming the outside of the cargo tank 1, the membrane primary barrier 200A contacting an extremely low temperature substance in the cargo tank 1, the primary insulated wall 300A provided outside the primary barrier 200A, the membrane secondary barrier 400A provided outside the primary insulated wall 300A, and the secondary insulated wall 500A provided outside the secondary barrier 400A and fixed to the hull shell 100.

The cargo tank 1 may be formed by the first cargo tank wall A alone. However, according to this embodiment, a description is made in reference to an example in which the cargo tank 1 is formed by combining the first cargo tank wall A with the second or third cargo tank wall B or C.

When the cargo tank 1 is formed by combining the first cargo tank wall A with the second or third cargo tank wall B or C to be described below, the first cargo tank wall A may be arranged to the corners or separated from the corners by a predetermined distance in order to reduce the effects caused by contraction of the second or third cargo tank wall B or C. As illustrated in FIG. 1, when two barrier blocks are coupled at the center of the cargo tank 1, the first cargo tank wall A may be provided at this location to prevent defects that may occur in the coupling part therebetween.

As illustrated in FIG. 2, the primary barrier 200A of the first cargo tank wall A may include a primary corrugated panel 210A and a primary main panel 220A. The primary barrier 200A may be bonded to the primary barrier 200B of the second cargo tank wall B to be described below or the primary barrier 200C of the third cargo tank wall C.

As illustrated in FIG. 1, the primary corrugated panel 210A may be arranged along a circumference of the corner line 6 defined by the floor 3, the vertical wall 4 and the ceiling 5 contacting the side wall 2 and may be arranged in a vertical direction to a central portion of the side wall 2.

The primary corrugated panel 210A may include a corner piece 212A and a corrugated portion 214A. The corner piece 212A may have a flat panel shape extending from the corner line 6 to a wall surface. The corrugated portion 214A may extend from the corner piece 212A and include a plurality of parallel corrugated cross-sections formed continuously along the corner line 6.

The corner piece 212A may be coupled to a primary main panel 220B or 220C of the second or third cargo tank wall B or C to be described below and formed of invar.

The corrugated portion 214A may not only absorb contraction deformation caused by temperature of the extremely low temperature substance but also absorb sloshing impact exerted on the corner line 6 during liquefied gas sloshing to prevent defects from occurring in the corner line 6. The corrugated portion 214A may be formed of invar.

The corner piece 212A and the corrugated portion 214A may not be limited to invar but may be formed of stainless steel or other materials.

The primary main panel 220A may be formed by connecting a plurality of insert panels 222A including flanges 223A facing neighboring panels. One side of the primary main panel 220A may be connected to the primary corrugated panel 210A, and the other side thereof may be coupled to the primary main panel 220B or 220C of the second or third cargo tank wall B or C to be described below.

The insert panel 222A may include invar. However, the insert panel 222A may not be limited to invar but may be formed of stainless steel or other materials.

The insert panel 222A may include auxiliary corrugation 230A. As enlarged in FIG. 31, the auxiliary corrugation 230A may be formed in a longitudinal direction. FIG. 31 illustrates a single auxiliary corrugation 230A. However, one or more auxiliary corrugations 230A may be provided. The auxiliary corrugation 230A may not only absorb contraction deformation by temperature of the extremely low temperature substance but also absorb sloshing impact exerted on the flange 223A to be described below during liquefied gas sloshing.

More specifically, when the insert panel 222A contracts in a width direction due to contact with the extremely low temperature substance, left and right sides of the insert panel 222A may contract on the basis of a welded portion of the flange 223A. At this time, the auxiliary corrugation 230A may be stretched out to prevent decoupling of the flanges 223A of the insert panels 222A, so that sealing of the primary barrier 200A may be maintained. In other words, the auxiliary corrugation 230A may prevent the insert panel 222A from being damaged when the insert panel 222A contracts in the width direction, and the primary corrugated panel 210A may prevent the insert panel 222A from being damaged when the insert panel 222A contracts in the longitudinal direction. In this embodiment, in order to prevent damage caused by contraction damage, a direction of corrugation of the primary corrugated panel 210A and the longitudinal direction of the insert panel 222A may be perpendicular to each other.

A height of the auxiliary corrugation 230A may be smaller than a protruding height of the flange 223A. The auxiliary corrugation 230A may also be formed on the primary main panels 220B and 220C of the second and third cargo tank walls B and C as well as the primary main panel 220A of the first cargo tank wall A.

An end cap 231A may be provided at an end portion of the auxiliary corrugation 230A. The end cap 231A may have a decreasing cross-sectional area in a direction away from the auxiliary corrugation 230A. More specifically, the end cap 231A may be formed by arcs, semicircular cross-sectional shapes, or a half-elliptical cross-sectional shapes which continuously decrease in size towards the primary corrugated panel 210A from the end of the auxiliary corrugation 230A. Therefore, the end cap 231A may be formed a shape similar to a quarter sphere shape. The end cap 231A may seal the end portion of the auxiliary corrugation 230A and reduce local stress that may occur in the bonding portion between the insert panel 222A and the primary corrugated panel 210A.

As illustrated in FIG. 2, the secondary barrier 400A of the first cargo tank wall A may be formed in a substantially similar manner to the primary barrier 200A and include a secondary corrugated panel 410A and a secondary main panel 420A. The secondary barrier 400A may be coupled to the secondary barrier 400B of the second cargo tank wall B to be described below or the secondary barrier 400C of the third cargo tank wall C to be described below.

As illustrated in FIG. 1, the secondary corrugated panel 410A may be arranged along a circumference of the corner line 6 defined by the floor 3, the vertical wall 4 and the ceiling 5 meeting the side wall 2 or may be arranged in a vertical direction to the center of the side wall 2. The secondary corrugated panel 410A may include a corner piece 412A and a corrugated portion 414A. The corner piece 412A may have a flat panel shape and extend from the corner line 6 to a wall surface. The corrugated portion 414A may extend from the corner piece 412A and include a plurality of parallel corrugated cross-sections continuously along the corner line 6.

The corner piece 412A may be connected to secondary main panels 420B and 420C of the second or third cargo tank wall B or C to be described below, formed of invar, and have a flat panel shape.

The corrugated portion 414A may not only absorb contraction deformation caused by temperature of the extremely low temperature substance but also absorb sloshing impact exerted on the corner line 6 during liquefied gas sloshing to prevent defects from occurring in the corner line 6. The corrugated portion 414A may be formed of invar.

The corner piece 412A and the corrugated portion 414A may not be limited to invar. However, the corner piece 412A and the corrugated portion 414A may be formed of stainless steel or other materials.

Corrugations of the corrugated portion 414A of the secondary barrier 400A may have a smaller depth and a greater pitch than those of the corrugated portion 214A of the primary barrier 200A. Since the corrugated portion 214A of the primary barrier 200A directly contacts the extremely low temperature substance, the corrugated portion 214A may be greatly affected by contraction or sloshing. On the other hand, since the corrugated portion 414A of the secondary barrier 400A is located between the primary insulated wall 300A and the secondary insulated wall 500A to be described below and does not contact the extremely low temperature substance, the corrugated portion 414A may be less affected by contraction or sloshing.

The secondary main panel 420A may be formed by connecting a plurality of insert panels 422A including flanges 423A facing neighboring panels. One side of the secondary main panel 420A may be connected to the secondary corrugated panel 410A by the insert panel 422A interposed at one side (opposite side to corner piece) of the corrugated portion 414A of the secondary corrugated panel 410A. The other side thereof may be connected to the secondary main panel 420B or 420C of the second or third cargo tank wall B or C to be described below.

The insert panel 422A may be formed of invar but not limited thereto. However, the insert panel 422A may be formed of stainless steel or other materials.

As described above, the primary main panel 220A of the first cargo tank wall A may be formed by connecting the plurality of insert panels 222A including the flanges 223A facing neighboring panels. The flanges 223A provided on the neighboring insert panels 222A may be connected to by welding (for example, resistance welding.)

Similarly, the secondary main panel 420A of the first cargo tank wall A may be formed by connecting the plurality of insert panels 422A including the flanges 423A facing neighboring panels. The flanges 423A provided on the neighboring insert panels 422A may be connected by welding.

In addition, a distance between the flanges 223A provided on the insert panels 222A of the primary barrier 200A may be smaller than a distance between the flanges 423A provided on the insert panels 422A of the secondary barrier 400A. The flange 223A of the primary barrier 200A and the flange 423A of the secondary barrier 400A may alternate with each other. When the flanges 222A and 423A of the primary barrier 200A and the secondary barrier 400A are arranged alternately with each other, welded connection parts thereof may also alternate with each other, so that the welding parts may be prevented from being damaged by leakage.

In addition, when the distance between the flanges 223A provided on the insert panels 222A of the primary barrier 200A is smaller than the distance between the flanges 423A provided on the insert panels 422A of the secondary barrier 400A, contractive displacement of the primary barrier 200A directly contacting the extremely low temperature substance may be sufficiently absorbed.

As illustrated in FIGS. 7 and 8, the primary insulated wall 300A of the first cargo tank wall A may include an upper plywood board 340A, an upper glass fiber reinforced epoxy composite (GRE) 370A, an insulation plate 310A and a lower glass fiber reinforced epoxy composite 380A. The primary insulated wall 300A may be provided between the primary barrier 200A and the secondary barrier 400A of the first cargo tank wall A. Both sides of the primary insulated wall 300A may be coupled to the primary insulated wall 300B or 300C of the second or third cargo tank wall B or C to be described below.

The upper plywood board 340A may be provided between the primary barrier 200A and the upper glass fiber reinforced epoxy composite 370A.

The upper glass fiber reinforced epoxy composite 370A may be a flat panel type reinforced member and be provided between the upper plywood board 340A and the insulation plate 310A to be described below. The upper glass fiber reinforced epoxy composite 370A may reinforce strength of the insulation plate 310A, which may be deteriorated due to a depression 360A formed in the insulation plate 310A to be described below, along with the lower glass fiber reinforced epoxy composite 380A.

The insulation plate 310A may be provided between the upper glass fiber reinforced epoxy composite 370A and the lower glass fiber reinforced epoxy composite 380A. The depression 360A may be formed in a bottom surface of the insulation plate 310A to receive the corrugated portion 414A formed on the secondary corrugated panel 410A of the secondary barrier 400A. The depression 360A may include a trapezoidal cross-section and a depth greater than height and width of the corrugated portion 414A in order to sufficiently receive the corrugated portion 414A. Therefore, a space may be formed between the corrugated portion 414A and depression 360A.

However, since a portion of the insulation plate 310A in which the depression 360A is formed has a smaller thickness than other portions thereof, strength may be relatively reduced. However, the reduction in thickness may be compensated by the lower glass fiber reinforced epoxy composite 380A including the depression 360A.

The insulation material 330A forming the insulation plate 310A may include high-density polyurethane foam having a density of 200 $kg/m^3$ or more.

The lower glass fiber reinforced epoxy composite 380A may be provided between the insulation plate 310A and the secondary barrier 400A and reinforce the insulation plate 310A, like the upper glass fiber reinforced epoxy composite 370A. However, since the lower glass fiber reinforced epoxy composite 380A is to tightly contact the bottom surface of the insulation plate 310A and at the same time to receive the corrugated portion 414A formed on the secondary corrugated panel 410A of the secondary barrier 400A, the depression 360A may be formed in the lower glass fiber reinforced epoxy composite 380A so that the lower glass fiber reinforced epoxy composite 380A may have the same shape as the bottom surface of the insulation plate 310A.

As illustrated in FIGS. 9 and 10, the secondary insulated wall 500A of the first cargo tank wall A may include an upper plywood board 540A, an insulation plate 510A and a lower plywood board 550A and be provided between the secondary barrier 400A of the first cargo tank wall A and the hull shell 100. Both sides of the secondary insulated wall 500A may be connected to the secondary insulated walls 500B or 500C of the second or third cargo tank wall B or C.

The upper plywood board 540A may be provided between the secondary barrier 400A and the insulation plate 510A.

The insulation plate 510A may be provided between the upper plywood board 540A and the lower plywood board 550A to be described below. An insulation material 530A used to form the insulation plate 510A may be formed of high-density polyurethane foam having a density of 200 kg/m$^3$ or more.

The lower plywood board 550A may be provided between the insulation plate 510A and the hull shell 100.

Figure 11:
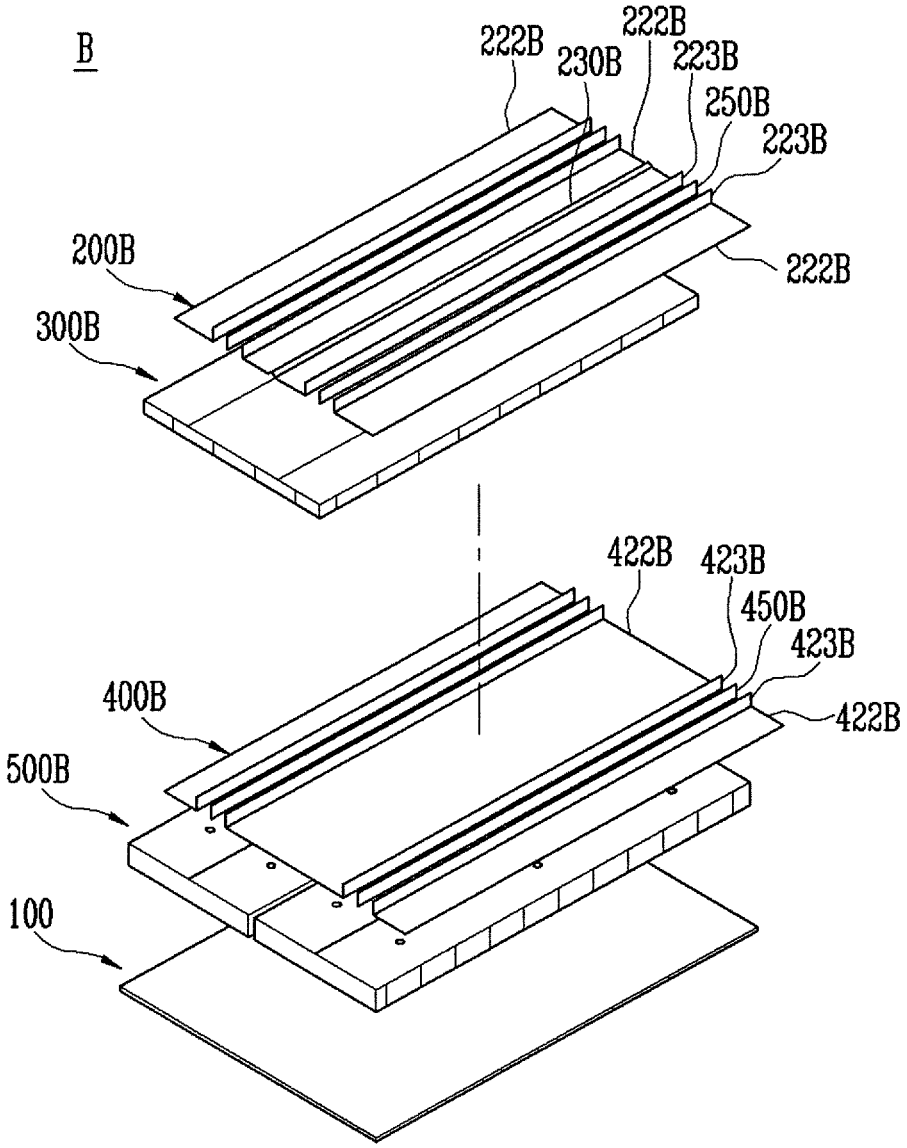
FIG. 11 is an exploded perspective view illustrating a second cargo tank wall according to an embodiment of the present invention.
Figure 12:
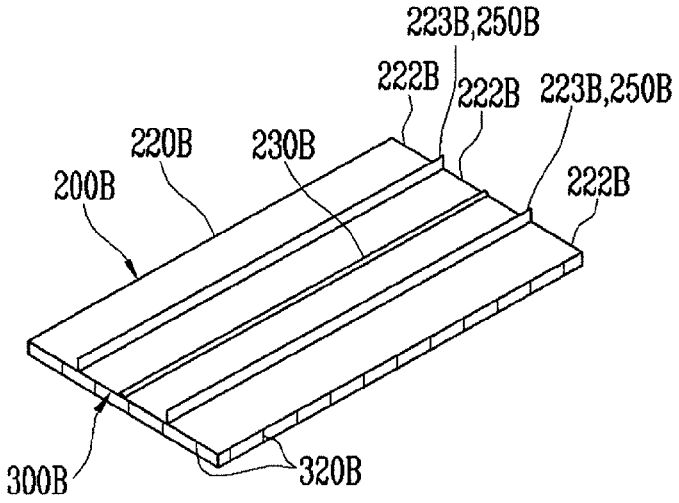
FIG. 12 is an assembled perspective view illustrating a primary barrier and a primary insulated wall of a second cargo tank wall according to an embodiment of the present invention.
Figure 13:
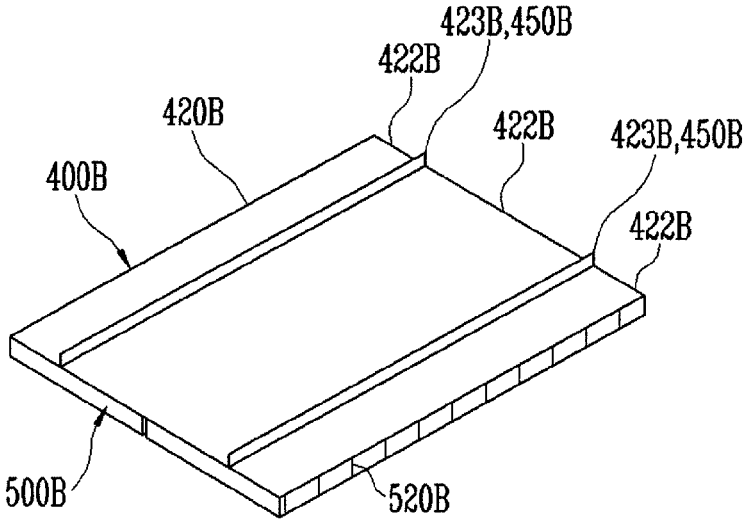
FIG. 13 is an assembled perspective view illustrating a secondary barrier and a secondary insulated wall of a second cargo tank wall according to an embodiment of the present invention.
Figure 14:
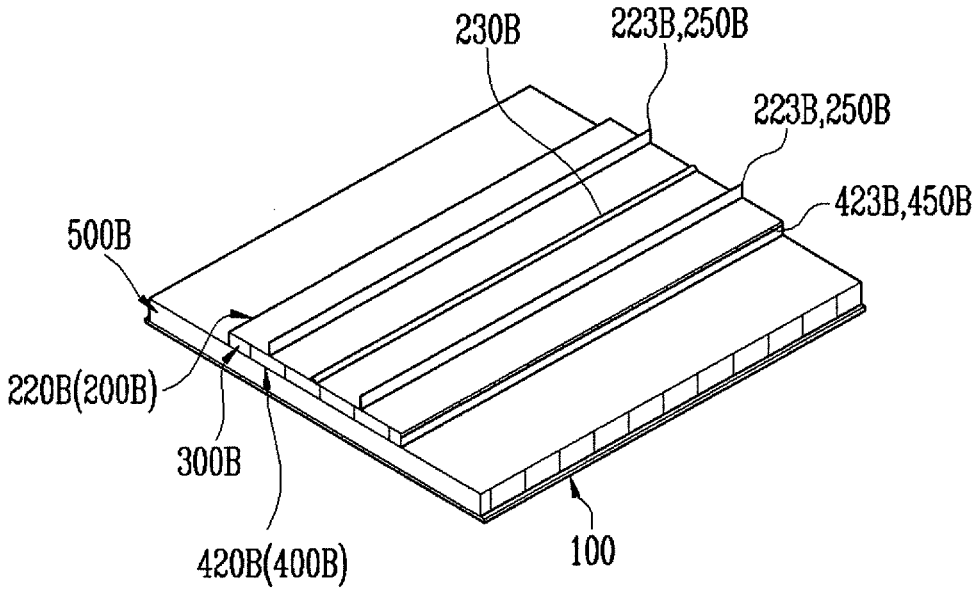
FIG. 14 is an assembled perspective view illustrating a primary barrier, a primary insulated wall, a secondary barrier and a secondary insulated wall of a second cargo tank wall according to an embodiment of the present invention.
Figure 15:
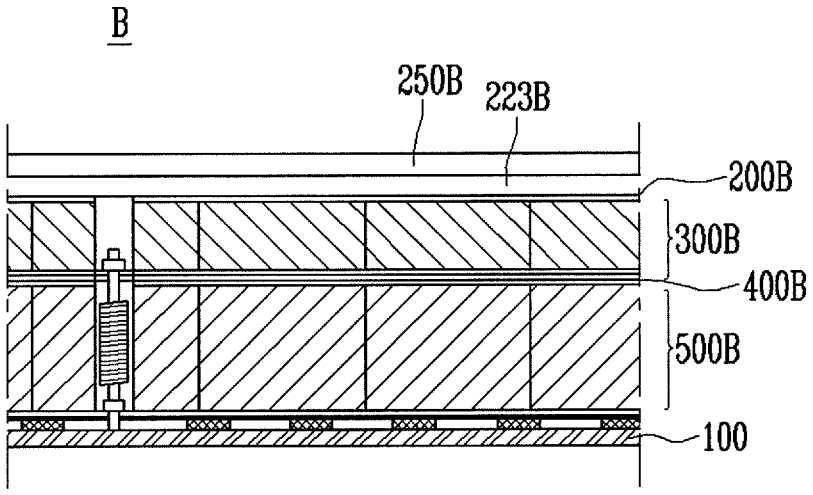
FIG. 15 is a partial cross-sectional view illustrating a second cargo tank wall according to an embodiment of the present invention.
Figure 16:
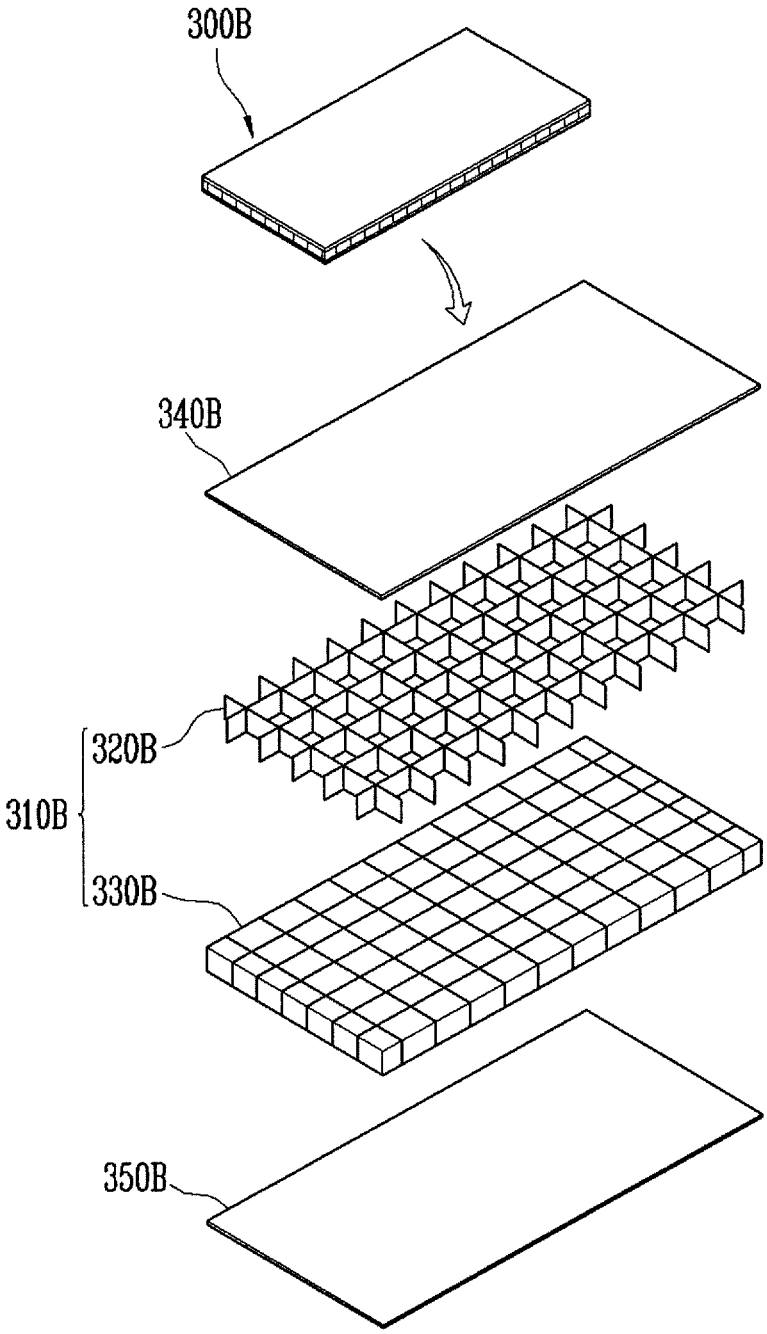
FIG. 16 is an exploded perspective view illustrating a primary insulated wall of a second cargo tank wall according to an embodiment of the present invention.
Figure 17:
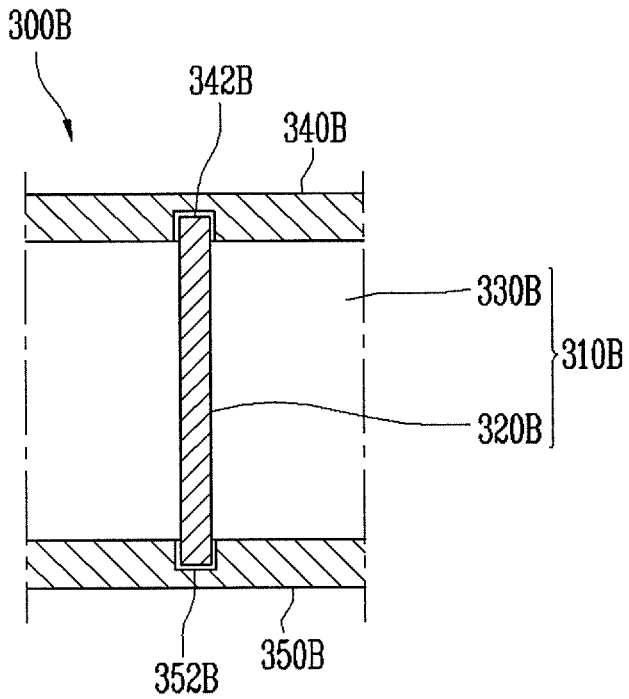
FIG. 17 is a partial cross-sectional view illustrating a primary insulated wall of a second cargo tank wall according to an embodiment of the present invention.
Figure 18:
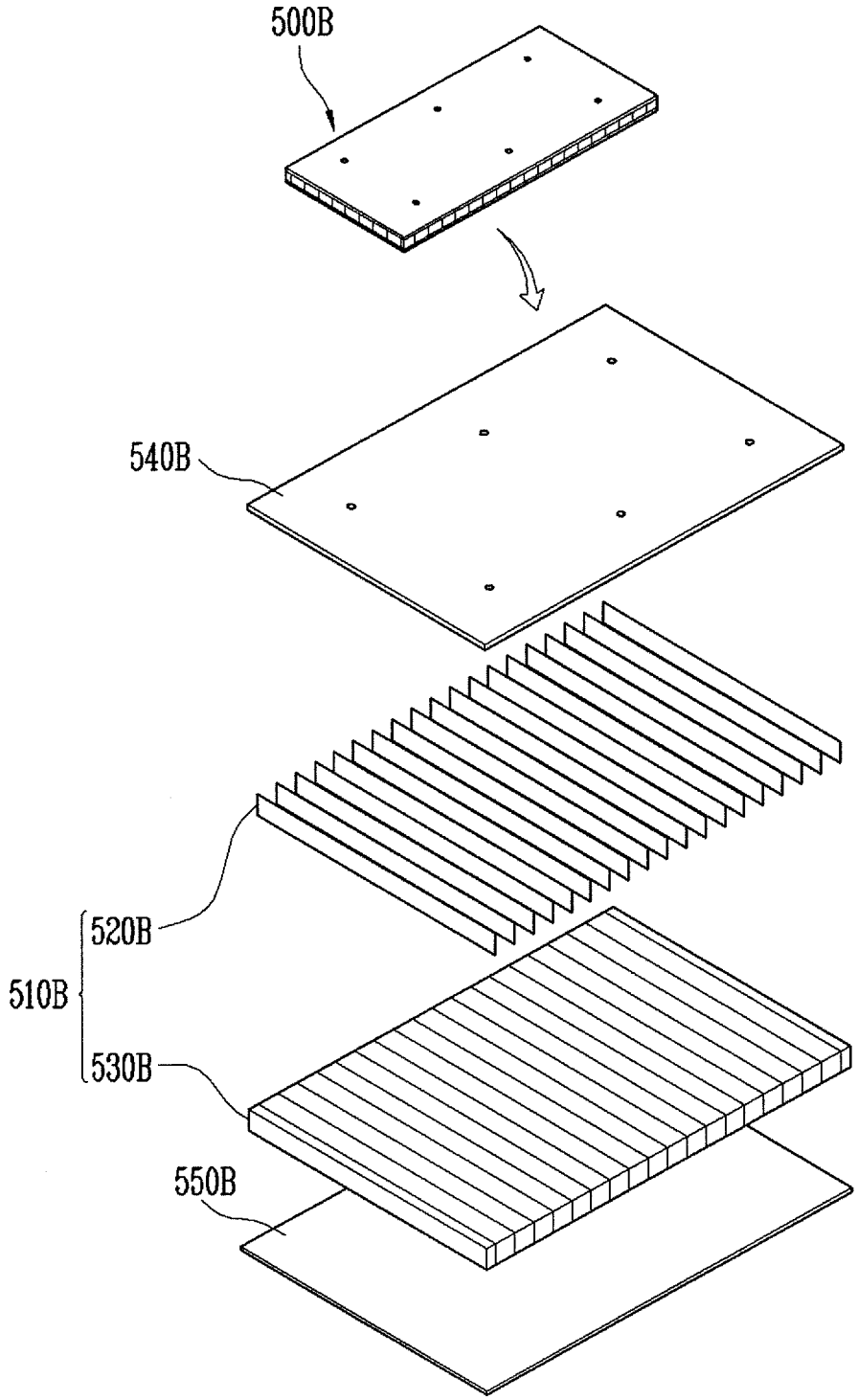
FIG. 18 is an exploded perspective view illustrating a secondary insulated wall of a second cargo tank wall according to an embodiment of the present invention.
Figure 19:
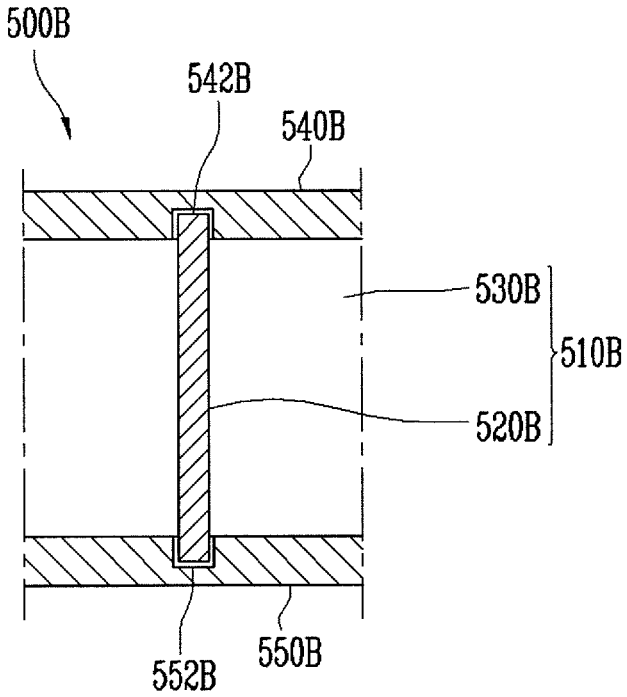
FIG. 19 is a partial cross-sectional view illustrating a secondary insulated wall of a second cargo tank wall according to an embodiment of the present invention.

FIG. 11 is an exploded perspective view illustrating a second cargo tank wall according to an embodiment of the present invention. FIG. 12 is an assembled perspective view illustrating a primary barrier and a primary insulated wall of a second cargo tank wall according to an embodiment of the present invention. FIG. 13 is an assembled perspective view illustrating a secondary barrier and a secondary insulated wall of a second cargo tank wall according to an embodiment of the present invention. FIG. 14 is an assembled perspective view illustrating a primary barrier, a primary insulated wall, a secondary barrier and a secondary insulated wall of a second cargo tank wall according to an embodiment of the present invention. FIG. 15 is a partial cross-sectional view illustrating a second cargo tank wall according to an embodiment of the present invention. FIG. 16 is an exploded perspective view illustrating a primary insulated wall of a second cargo tank wall according to an embodiment of the present invention. FIG. 17 is a partial cross-sectional view illustrating a primary insulated wall of a second cargo tank wall according to an embodiment of the present invention. FIG. 18 is an exploded perspective view illustrating a secondary insulated wall of a second cargo tank wall according to an embodiment of the present invention. FIG. 19 is a partial cross-sectional view illustrating a secondary insulated wall of a second cargo tank wall according to an embodiment of the present invention.

As illustrated in FIGS. 11 to 19, the second cargo tank wall B according to an embodiment may include the hull shell 100 forming the outside of the cargo tank 1, the membrane primary barrier 200B contacting an extremely low temperature substance in the cargo tank 1, the primary insulated wall 300B provided outside the primary barrier 200B, the membrane secondary barrier 400B provided outside the primary insulated wall 300, and the secondary insulated wall 500B provided outside the secondary barrier 400B and fixed to the hull shell 100.

The cargo tank 1 may be formed by the second cargo tank wall B alone. However, according to this embodiment, a description is made in reference to an example in which the cargo tank 1 is formed by combining the second cargo tank wall B with the first cargo tank wall A. In another example, the cargo tank 1 may be formed by combining the second cargo tank wall B with the third cargo tank wall C.

When the cargo tank 1 is formed by combining the second cargo tank wall B with the first cargo tank wall A, the second cargo tank wall B may be formed on the whole or selected parts, except for the part where the first cargo tank wall A is provided. For example, when the first cargo tank wall A is provided on the corner line 6 of the cargo tank 1, the second cargo tank wall B may be selectively formed on the side wall 2, the floor 3, the vertical wall 4 and the ceiling 5 except for the corner line 6. In addition, the second cargo tank wall B may be selectively provided on the floor 3 and the ceiling 5 which are less affected by liquefied gas sloshing or the side wall 2 and the vertical wall 4 which are more affected by liquefied gas sloshing.

As illustrated in FIG. 11, the primary barrier 200B of the second cargo tank wall B may include the primary main panel 220B. The primary barrier 200B may be bonded to the primary barrier 200A of the first cargo tank wall A.

The primary main panel 220B may be formed by connecting a plurality of unit panels 222B including flanges 223B facing neighboring panels. The primary main panel 220B may be connected to the primary main panel 220A of the first cargo tank wall A. When the second cargo tank wall B is combined with the third cargo tank wall C, the primary main panel 220B of the second cargo tank wall B may be connected to the primary main panel 220C of the third cargo tank wall C to be described below.

The primary main panel 220B may be a flat panel formed of stainless steel. However, the primary main panel 220B may not be limited to stainless steel and be formed of invar or other materials.

Auxiliary corrugation 230B may be formed on the primary main panel 220B. The auxiliary corrugation 230B of the primary main panel 220B may have substantially the same shape as the auxiliary corrugation 230A formed on the primary main panel 220A of the first cargo tank wall A as described above. In addition, the auxiliary corrugation 230B and the auxiliary corrugation 230A may be on the same plane and communicate with each other when the auxiliary corrugation 230B and the auxiliary corrugation 230A are coupled to each other.

As enlarged in FIG. 31, the auxiliary corrugation 230B may be formed in the longitudinal direction. Since the auxiliary corrugation 230B has substantially the same shape and functions as the auxiliary corrugation 220A formed on the primary main panel 220A of the first cargo tank wall A, a detailed description thereof will be omitted.

As illustrated in FIG. 11, the secondary barrier 400B of the second cargo tank wall B may have a substantially similar shape to the primary barrier 200B and include the secondary main panel 420B. The secondary barrier 400B may be bonded to the secondary barrier 400A of the first cargo tank wall A.

The secondary main panel 420B may be formed by connecting a plurality of unit panels 422B including a plurality of flanges 423B facing neighboring panels and connected to the secondary main panel 420A of the first cargo tank wall A. When the second cargo tank wall B is combined with the third cargo tank wall C to be described below, the secondary main panel 420B of the second cargo tank wall B may be connected to the secondary main panel 420C may be coupled to the third cargo tank wall C to be described below.

The secondary main panel 420B may be a flat panel formed of stainless steel. However, the secondary main panel 420B may not be limited to stainless steel and be formed of other materials.

As described above, the primary main panel 220B of the second cargo tank wall B may be formed by connecting the plurality of unit panels 222B including the flanges 223B facing neighboring panels. In addition, double tongues 250B may be inserted and fixed to the primary insulated wall 300B at intervals corresponding to widths of the unit panels 222B. Each of the unit panels 222B may be arranged between neighboring double tongues 250B. The unit panel 222B may be arranged between neighboring double tongues 250B. The flanges 223B of the neighboring unit panels 222B may be welded to both surfaces of the double tongue 250B interposed therebetween.

Similarly, the secondary main panel 420B of the second cargo tank wall B may be formed by connecting the plurality of unit panels 422B including the flanges 423B facing neighboring panels. In addition, double tongues 450B may be inserted and fixed to the secondary insulated wall 500B to be described below at the intervals corresponding to the widths of the unit panels 422B. The unit panel 420B may be arranged between neighboring double tongues 450B. The flanges 423B of the neighboring unit panels 420B may be welded to both surfaces of the double tongue 450B interposed therebetween.

According to this embodiment, the unit panels 222B of the primary main panel 220B may be connected by the double tongues 250B, and the unit panels 422B of the secondary main panel 420B may be connected by a single tongue (not illustrated).

Figure 29:
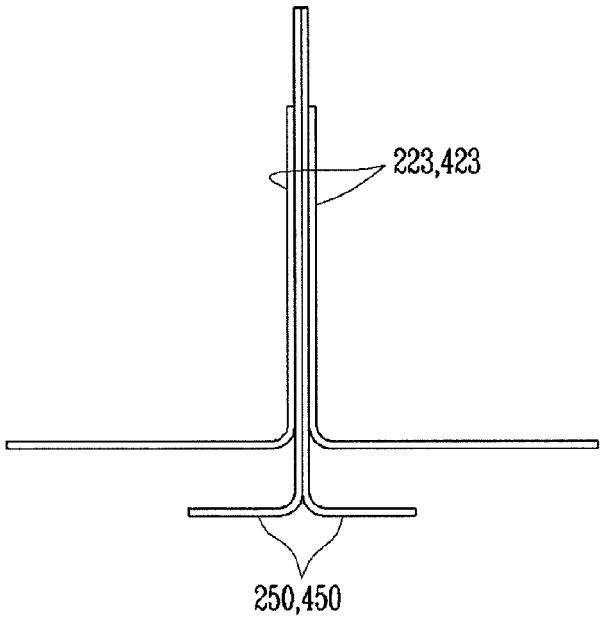
FIG. 29 is an enlarged front view illustrating a double tongue according to an embodiment of the present invention.
Figure 30:
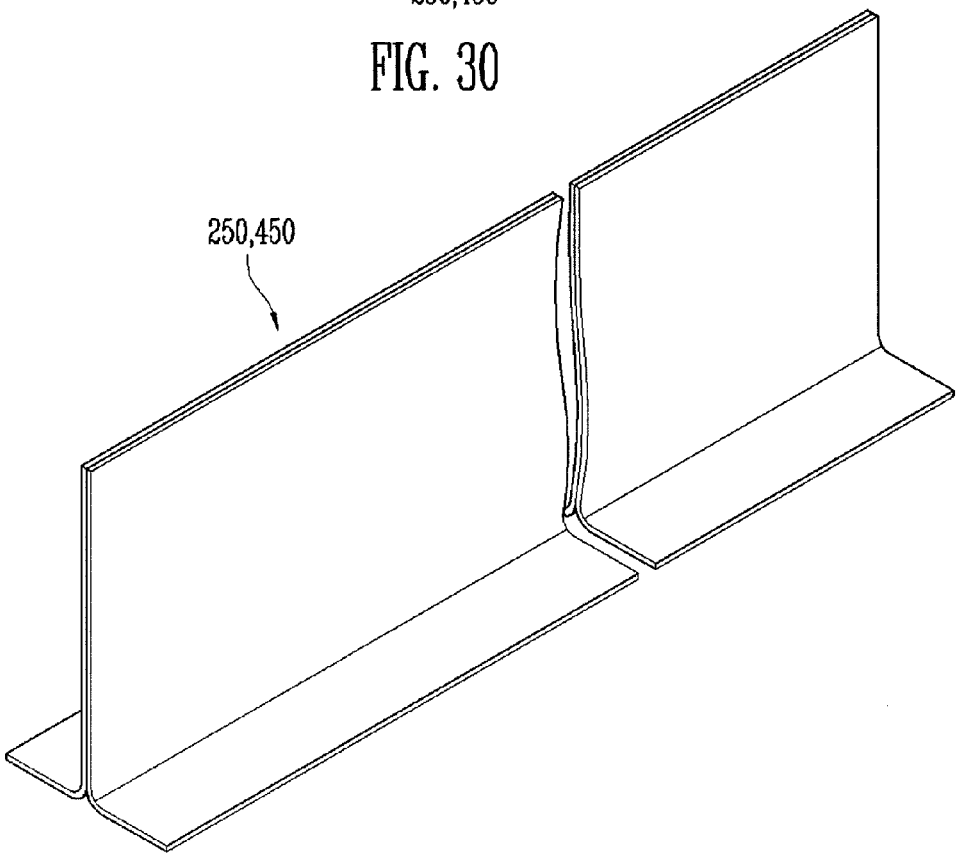
FIG. 30 is an enlarged perspective view illustrating a double tongue according to an embodiment of the present invention.

FIGS. 29 and 30 illustrate structures of the double tongues 250B and 450B.

In addition, a distance between neighboring double tongues 250B of the primary barrier 200B may be smaller than a distance between the double tongues 450B of the secondary barrier 400B. The double tongues 250B of the primary barrier 200B and the double tongues 450B of the secondary barriers 400B may alternate with each other. When the double tongues 250B of the primary barrier 200B and the double tongues 450B of the secondary barriers 400B are arranged alternately with each other, welded connection portions thereof may also alternate with each other, so that the welded connection portions may be prevented from being damaged by leakage and insulation performance may be improved.

In addition, when the distance between neighboring double tongues 250B of the primary barrier 200B is smaller than the distance between the double tongues 450B of the secondary barrier 400B, damage caused by contraction of the primary barrier 200B directly contacting the extremely low temperature substance may be sufficiently prevented.

As illustrated in FIGS. 16 and 17, the primary insulated wall 300B of the second cargo tank wall B may include an upper plywood board 340B, an insulation plate 310B and a lower plywood board 350B and be provided between the primary barrier 200B and the secondary barrier 400B of the second cargo tank wall B. Both sides of the primary insulated wall 300B may be connected to the primary insulated wall 300A of the first cargo tank wall A.

The upper plywood board 340B may be welded to the flanges 223B to which the double tongues 250B are inserted and fixed on the primary barrier 200B.

The insulation plate 310B may be provided between the upper plywood board 340B and the lower plywood board 350B to be described below.

The insulation plate 310B may include an upper glass fiber reinforced epoxy composite 320B including a plurality of glass fiber reinforced epoxy resin composite plates having a lattice structure and an insulation material 330B filling the lattice structure of the upper glass fiber reinforced epoxy composite 320B.

The insulation material 330B may be formed of low-density polyurethane foam having a density of 45 kg/m$^3$ or less.

The upper glass fiber reinforced epoxy composite 320B may traverse a plurality of glass fiber reinforced epoxy composite plates in a thickness direction (up-and-down direction in FIGS. 16 and 17) of the primary insulated wall 300B. In other words, the glass fiber reinforced epoxy composite plates may be raised in a thickness direction of the insulation material 330B. Thus, the glass fiber reinforced epoxy composite plates may form the lattice structure to support compressive loads applied in the thickness direction of the insulation material 330B. The upper glass fiber reinforced epoxy composite 320B may prevent the primary insulated wall 300B from being bent up and down on the basis of a front-rear cross section or a left-right cross section. In other words, since the upper glass fiber reinforced epoxy composite 320B having the lattice structure is provided on the insulation material 330B formed of polyurethane foam, the primary insulated wall 300B may serve as a rigid body.

The lattice structure may vary depending on capacity of the cargo tank 1, the size of a ship and required strength. The lattice structure may include congruent polygons, such as a triangle, square, pentagon or hexagon, or any regular shapes. In another example, the upper glass fiber reinforced epoxy composite 320B may have various structures such as glass fiber reinforced epoxy composite plates arranged in parallel in a horizontal direction or a vertical direction.

In addition, the upper glass fiber reinforced epoxy composite 320B may be formed integrally with the insulation material 330B by burying the upper glass fiber reinforced epoxy composite 320B in the insulation material 330B.

In order to bury the upper glass fiber reinforced epoxy composite 320B in the insulation material 330B, when the insulation material 330B is formed by foaming, the upper glass fiber reinforced epoxy composite 320B may also be injection-molded by "insert molding." In other words, when the upper glass fiber reinforced epoxy composite 320B is put in a cavity of a mold for forming the insulation material 330B by foaming, if a foam molding process is performed by putting polyurethane in the cavity, the upper glass fiber reinforced epoxy composite 320B may be buried in the insulation material 330B of polyurethane foam into a single body. In another example, pieces of the insulation material 330B and the upper glass fiber reinforced epoxy composite 320B may be separately manufactured. Subsequently, after the pieces of the insulation material 330B may be inserted into the lattice structure of the upper glass fiber reinforced epoxy composite 320B, the upper and lower plywood boards 340B, 350B may be bonded thereto by an adhesive.

In the present invention, the low-density polyurethane foam having a density of 45 kg/m$^3$ or less or the medium-density polyurethane foam having a density of approximately 135 kg/m$^3$, which is used to form the insulation material 330B, may have lower value and higher heat insulation performance but lower compressive strength and lower rigidity than the high-density polyurethane foam having a density of 200 kg/m$^3$ or more. Thus, in the present invention, compressive strength and rigidity of the insulation material 330B may be reinforced by inserting the upper glass fiber reinforced epoxy composite 320B therein.

The lower plywood board 350B may be provided between the insulation plate 310B and the secondary barrier 400B.

As illustrated in FIG. 17, bonding strength between the upper and lower plywood boards 340B and 350B and the insulation plate 310B may be improved by forming slits 342B and 352B corresponding to the arrangement of the upper glass fiber reinforced epoxy composite 320B in the upper plywood board 340B and the lower plywood board 350B and inserting the upper glass fiber reinforced epoxy composite 320B into the slits 342B and 352B.

As illustrated in FIGS. 18 and 19, the secondary insulated wall 500B of the second cargo tank wall B may include an upper plywood board 540B, an insulation plate 510B and a lower plywood board 550B and be provided between the secondary barrier 400B of the second cargo tank wall B and the hull shell 100. Both sides of the secondary insulated wall 500B may be connected to the secondary insulated wall 500A of the first cargo tank wall A.

The upper plywood board 540B may be welded to the flanges 423B to which the double tongues 450B are inserted and fixed on the secondary barrier 400B.

The insulation plate 510B may be provided between the upper plywood board 540B and the lower plywood board 550B to be described below.

The insulation plate 510B may include a lower glass fiber reinforced epoxy composite 520B in which a plurality of glass fiber reinforced epoxy composite plates form a parallel structure and the insulation material 530B filling the parallel structure of the lower glass fiber reinforced epoxy composite 520B.

The insulation material 530B may include low-density polyurethane foam having a density of 45 kg/m$^3$ or less.

The lower glass fiber reinforced epoxy composite 520B may traverse the glass fiber reinforced epoxy composite plates in a thickness direction of the secondary insulated wall 500B (up-and-down direction in FIGS. 18 and 19). In other words, the glass fiber reinforced epoxy composite plates may be raised in the thickness direction of the insulation material 530B. As a result, the glass fiber reinforced epoxy composite plates may form the parallel structure to support compressive loads applied in the thickness direction of the insulation material 530B.

The lower glass fiber reinforced epoxy composite 520B may have the parallel structure rather than the lattice structure of the upper glass fiber reinforced epoxy composite 320B. If the lower glass fiber reinforced epoxy composite 520B also has a lattice structure, both the primary insulated wall 300B and the secondary insulated wall 500B may serve as a rigid body, impact may not be absorbed by the insulated walls 300B and 500B and may be transferred to the upper and lower plywood boards 340B, 350B, 540B and 550B. As a result, the plywood boards 340B, 350B, 540B and 550B may be damaged. In other words, in this embodiment, the lower glass fiber reinforced epoxy composite 520B may have the parallel structure so that the secondary insulated wall 500B may be bent in at least one direction to sufficiently absorb the impact. As a result, the plywood boards 340B, 350B, 540B and 550B may be prevented from being damaged.

The parallel structure of the lower glass fiber reinforced epoxy composite 520B may vary depending on capacity of the cargo tank 1, the size of a ship and required strength. The lower glass fiber reinforced epoxy composite 520B may have various structures, such as repetitive straight lines, repetitive curved lines or repetitive arbitrary lines, or irregular shapes.

In addition, the lower glass fiber reinforced epoxy composite 520B may be formed integrally with the insulation material 330B by burying the lower glass fiber reinforced epoxy composite 520B in the insulation material 330B.

In order to bury the lower glass fiber reinforced epoxy composite 520B in the insulation material 530B, when the insulation material 530B is formed by foaming, the lower glass fiber reinforced epoxy composite 520B may also be injection-molded by "insert molding." In other words, when the lower glass fiber reinforced epoxy composite 520B is provided in a cavity of a mold for forming the insulation material 530B by foaming, if a foam molding process is performed by putting polyurethane in the cavity, the lower glass fiber reinforced epoxy composite 520B may be buried in the insulation material 530B of polyurethane foam. In another example, pieces of the insulation material 530B and the lower glass fiber reinforced epoxy composite 520B may be separately manufactured. The pieces of the insulation material 530B may be inserted into space of the lower glass fiber reinforced epoxy composite 520B and bonded with an adhesive.

In the present invention, the low-density polyurethane foam having a density of 45 kg/m$^3$ or less, which is used to form the insulation material 530B, may have lower value and higher heat insulation performance but lower compressive strength and lower rigidity than the polyurethane foam having a density of approximately 130 kg/m$^3$. Thus, according to the present invention, compressive strength and rigidity of the insulation material 530B may be reinforced by inserting the lower glass fiber reinforced epoxy composite 520B therein.

The lower plywood board 550B may be provided between the insulation plate 510B and the hull shell 100.

As described above, a description has been made to an example in which the upper glass fiber reinforced epoxy composite 320B has the lattice structure and the lower glass fiber reinforced epoxy composite 520B has the parallel structure. However, the upper glass fiber reinforced epoxy composite 320B may have a parallel structure and the lower glass fiber reinforced epoxy composite 520B may have a lattice structure. In other words, in order to prevent impact from being transferred to the plywood boards 340B, 350B, 540B and 550B, one of the two glass fiber reinforced epoxy composites 320B and 520B may have a lattice structure, and the other may have a parallel structure.

Figure 20:
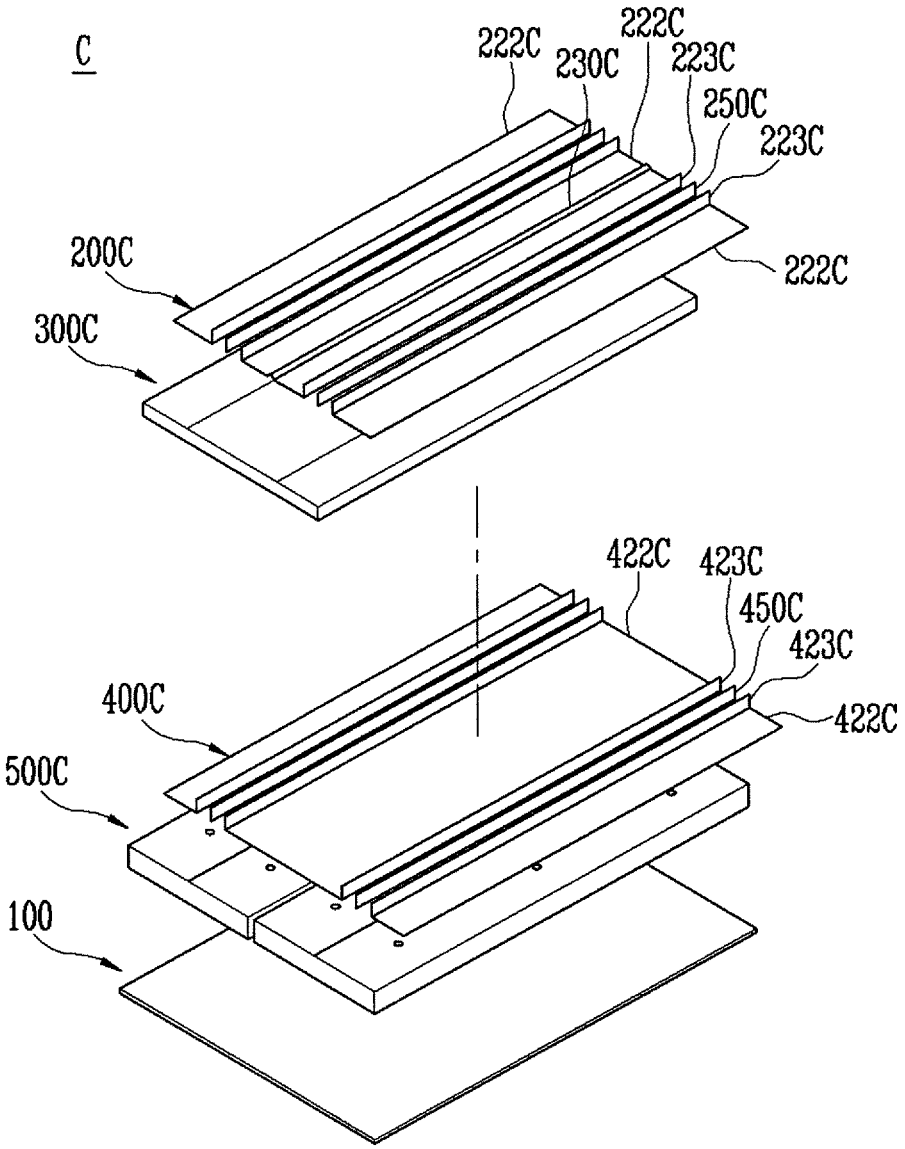
FIG. 20 is an exploded perspective view illustrating a third cargo tank wall according to an embodiment of the present invention.
Figure 21:
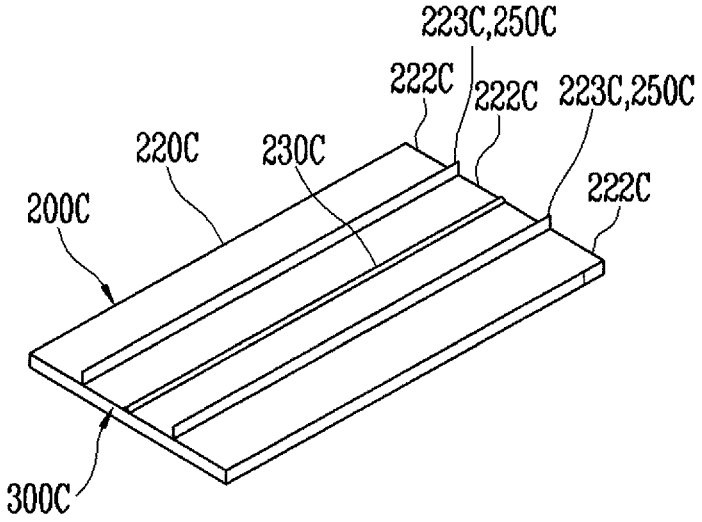
FIG. 21 is an assembled perspective view illustrating a primary barrier and a primary insulated wall of a third cargo tank wall according to an embodiment of the present invention.
Figure 22:
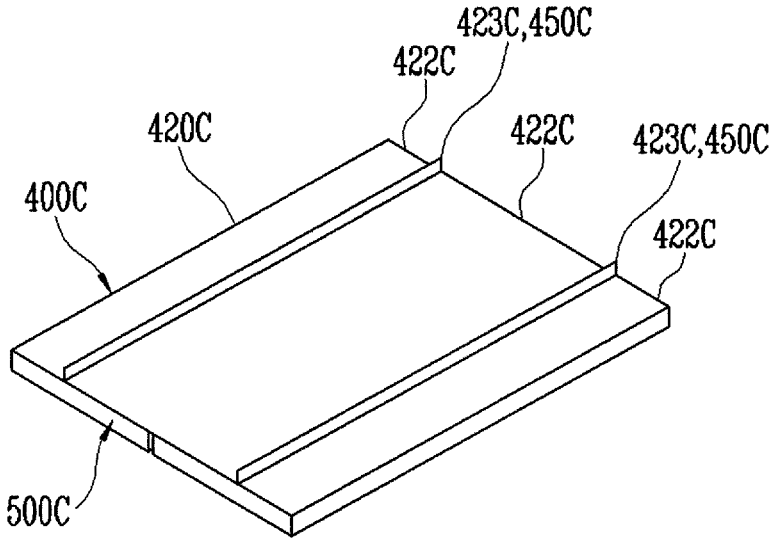
FIG. 22 is an assembled perspective view illustrating a secondary barrier and a secondary insulated wall of a third cargo tank wall according to an embodiment of the present invention.
Figure 23:
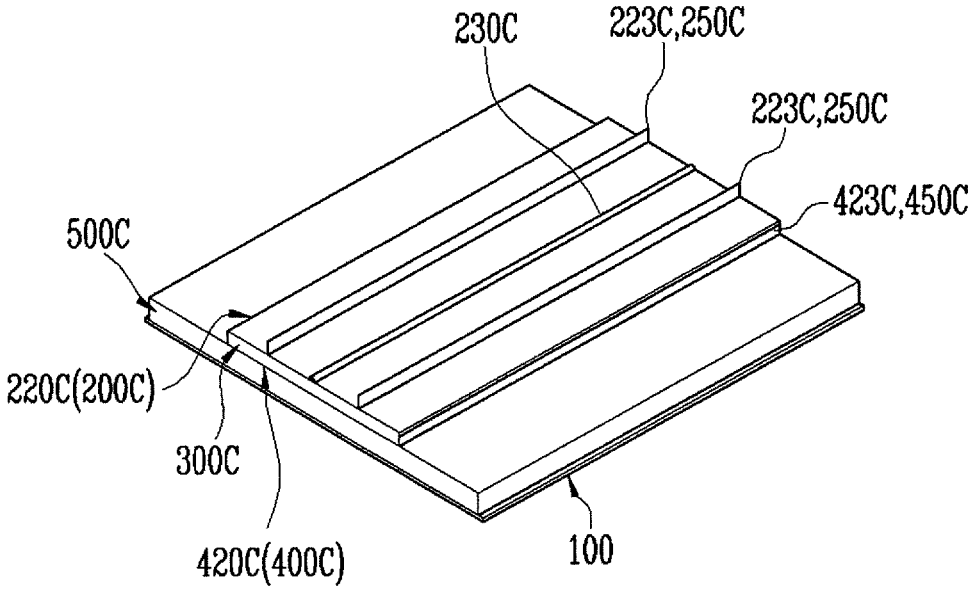
FIG. 23 is an assembled perspective view illustrating a primary barrier, a primary insulated wall, a secondary barrier and a secondary insulated wall of a third cargo tank wall according to an embodiment of the present invention.
Figure 24:
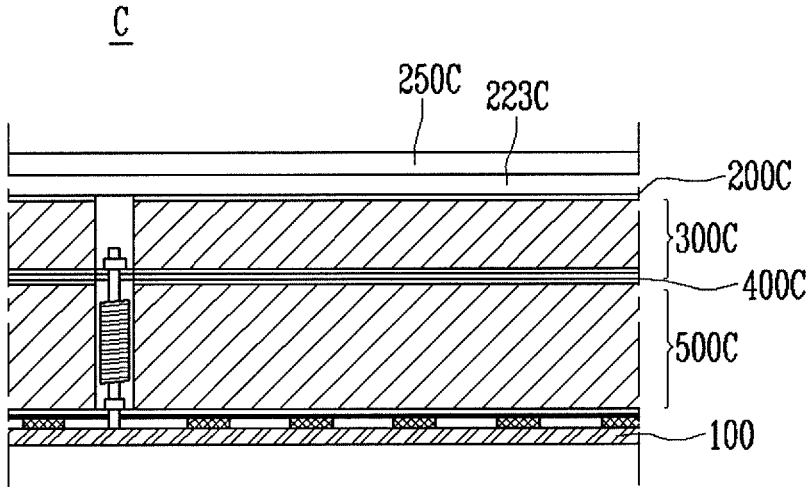
FIG. 24 is a partial cross-sectional view illustrating a third cargo tank wall according to an embodiment of the present invention.
Figure 25:
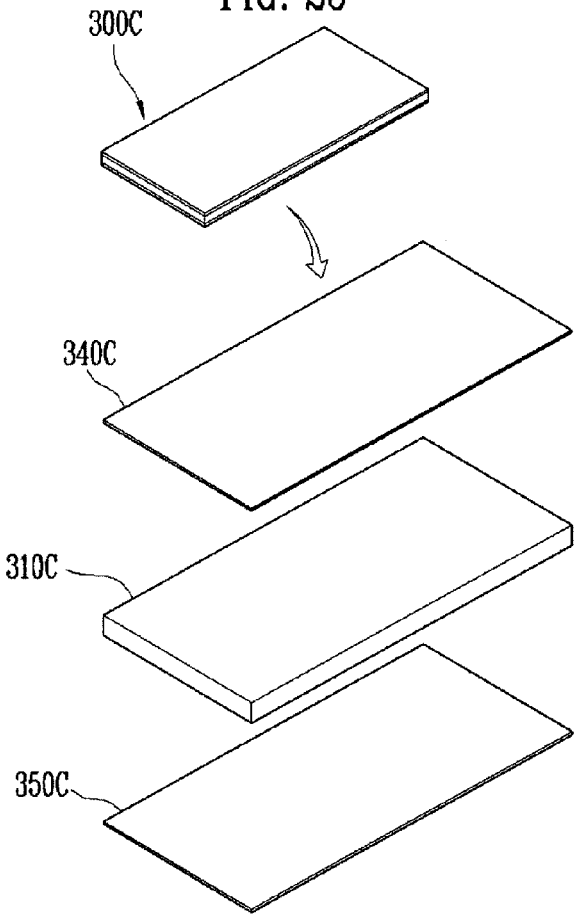
FIG. 25 is an exploded perspective view illustrating a primary insulated wall of a third first cargo tank wall according to an embodiment of the present invention.
Figure 26:
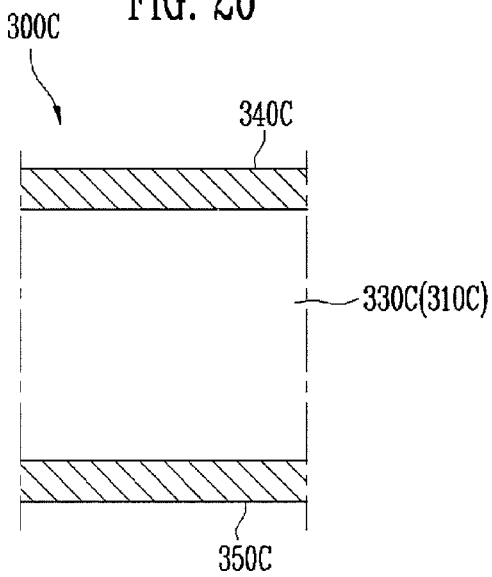
FIG. 26 is a partial cross-sectional view illustrating a primary insulated wall of a third cargo tank wall according to an embodiment of the present invention.
Figure 27:
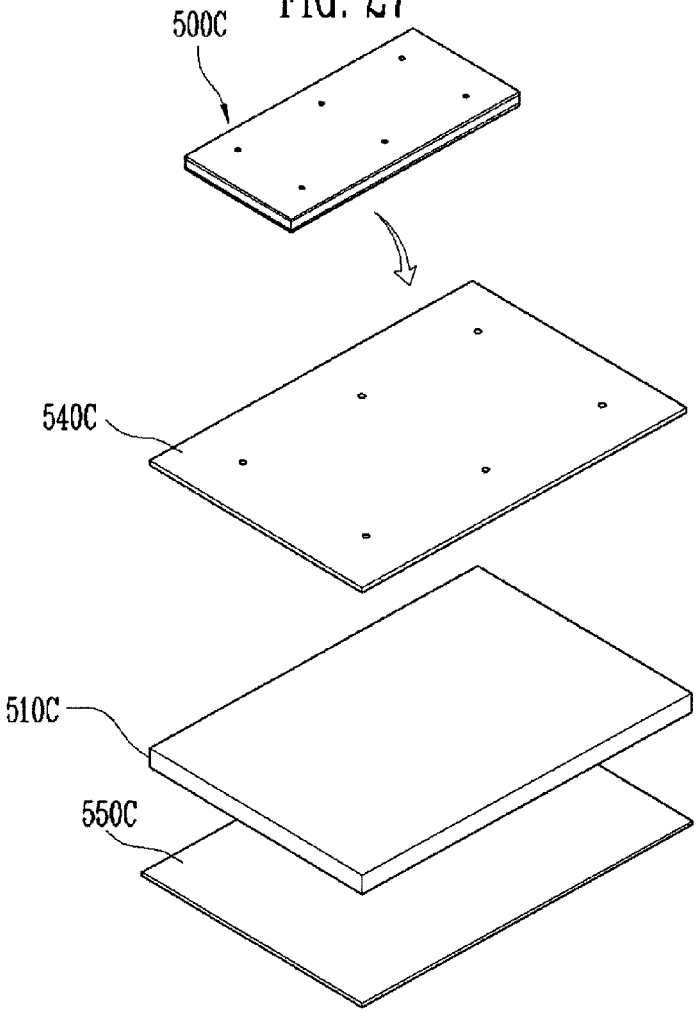
FIG. 27 is an exploded perspective view illustrating a secondary insulated wall of a third cargo tank wall according to an embodiment of the present invention.
Figure 28:
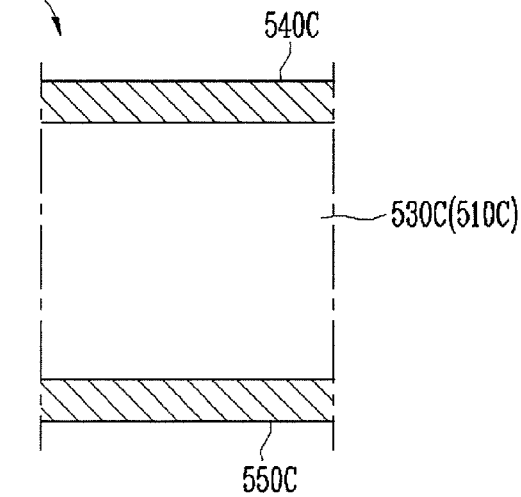
FIG. 28 is a partial cross-sectional view illustrating a secondary insulated wall of a third cargo tank wall according to an embodiment of the present invention.

FIG. 20 is an exploded perspective view illustrating a third cargo tank wall according to an embodiment of the present invention. FIG. 21 is an assembled perspective view illustrating a primary barrier and a primary insulated wall of a third cargo tank wall according to an embodiment of the present invention. FIG. 22 is an assembled perspective view illustrating a secondary barrier and a secondary insulated wall of a third cargo tank wall according to an embodiment of the present invention. FIG. 23 is an assembled perspective view illustrating a primary barrier, a primary insulated wall, a secondary barrier and a secondary insulated wall of a third cargo tank wall according to an embodiment of the present invention. FIG. 24 is a partial cross-sectional view illustrating a third cargo tank wall according to an embodiment of the present invention. FIG. 25 is an exploded perspective view illustrating a primary insulated wall of a third first cargo tank wall according to an embodiment of the present invention. FIG. 26 is a partial cross-sectional view illustrating a primary insulated wall of a third cargo tank wall according to an embodiment of the present invention. FIG. 27 is an exploded perspective view illustrating a secondary insulated wall of a third cargo tank wall according to an embodiment of the present invention. FIG. 28 is a partial cross-sectional view illustrating a secondary insulated wall of a third cargo tank wall according to an embodiment of the present invention.

As illustrated in FIGS. 20 to 28, the third cargo tank wall C according to an embodiment may include the defining the outside of the cargo tank 1, the membrane primary barrier 200C contacting an extremely low temperature substance in the cargo tank 1, the primary insulated wall 300C provided outside the primary barrier 200C, the membrane secondary barrier 400C provided outside the primary insulated wall 300C, and the secondary insulated wall 500C provided outside the secondary barrier 400C and fixed to the hull shell 100.

The cargo tank 1 may be formed by the third cargo tank wall C alone. However, according to this embodiment, a description is made in reference to an example in which the cargo tank 1 is formed by combining the third cargo tank wall C with the first cargo tank wall A. In another example, the cargo tank 1 may be formed by combining the third cargo tank wall C with the second cargo tank wall B.

When the cargo tank 1 is formed by combining the third cargo tank wall C with the first cargo tank wall A, the third cargo tank wall C may be formed on the whole or selected parts except for the part where the first cargo tank wall A is provided. For example, when the first cargo tank wall A is provided on the corner line 6 of the cargo tank 1, the third cargo tank wall C may be selectively formed on the side wall 2, the floor 3, the vertical wall 4 and the ceiling 5 except for the corner line 6. In addition, the third cargo tank wall C may be selectively provided on the floor 3 and the ceiling 5 which are less affected by liquefied gas sloshing or the side wall 2 and the vertical wall 4 which are more affected by liquefied gas sloshing.

As illustrated in FIG. 20, the primary barrier 200C of the third cargo tank wall C may include the primary main panel 220C. The primary barrier 200C may be bonded to the primary barrier 200A of the first cargo tank wall A.

The primary main panel 220C may be formed by connecting a plurality of unit panels 222C including flanges 223C facing neighboring panels. The primary main panel 220C may be connected to the primary main panel 220A of the first cargo tank wall A. When the third cargo tank wall C is combined with the second cargo tank wall B, the primary main panel 220C of the third cargo tank wall C may be connected to the primary main panel 220B of the second cargo tank wall B.

The primary main panel 220C may be a flat panel formed of stainless steel. However, the primary main panel 220C may not be limited to stainless steel and be formed of invar or other materials.

The auxiliary corrugation 230C may be formed on the primary main panel 220C. The auxiliary corrugation 230C of the primary main panel 220C may have substantially the same shape as the auxiliary corrugation 230A formed on the primary main panel 220A of the first cargo tank wall A and the auxiliary corrugation 230B formed on the primary main panel 220B of the second cargo tank wall B. In addition, the auxiliary corrugation 230C, the auxiliary corrugation 230A and the auxiliary corrugation 230B may be arranged in the same plane and communicate with each other when the auxiliary corrugations 230A, 230B and 230C are coupled to each other.

As enlarged in FIG. 31, the auxiliary corrugation 230C may be formed in a longitudinal direction. Since the auxiliary corrugation 230C has the same shape and function as the auxiliary corrugations 230A and 230B of the primary and secondary main panels 220A and 220B of the first and second cargo tank walls A and B, a detailed description thereof will be omitted.

As illustrated in FIG. 20, the secondary barrier 400C of the third cargo tank wall C may have a substantially similar shape to the primary barrier 200C and include the secondary main panel 420C. The secondary barrier 400C may be bonded to the secondary barrier 400A of the first cargo tank wall A.

The primary main panel 420C may be formed by connecting a plurality of unit panels 422C including flanges 423C facing neighboring panels. The primary main panel 420C may be connected to the primary main panel 420A of the first cargo tank wall A. When the third cargo tank wall C is combined with the second cargo tank wall B, the primary main panel 420C of the third cargo tank wall C may be connected to the secondary main panel 420B of the second cargo tank wall B.

The primary main panel 420C may be a flat panel formed of stainless steel. However, the primary main panel 420C may not be limited to stainless steel but be formed of invar or other materials.

As described above, the primary main panel 220C of the third cargo tank wall C may be formed by connecting the plurality of unit panels 222C including the flanges 223C facing neighboring panels. In addition, the double tongues 250C may be inserted and fixed to the primary insulated wall 300C to be described below at intervals corresponding to widths of the unit panels 222C. Each of the unit panels 222C may be arranged between neighboring double tongues 250C. The unit panel 222C may be arranged between neighboring double tongues 250C. The flanges 223C provided on the neighboring unit panels 222C may be welded to both surfaces of the double tongue 250C interposed therebetween.

Similarly, the secondary main panel 420C of the third cargo tank wall C may be formed by connecting the plurality of unit panels 422C including the flanges 423C facing neighboring panels. In addition, the double tongues 450C may be inserted and fixed to the secondary insulated wall 500C to be described below at the intervals corresponding to the widths of the unit panels 422C. The unit panel 420C may be arranged between neighboring double tongues 450C. The flanges 423C of the neighboring unit panels 420C may be welded to both surfaces of the double tongue 450C interposed therebetween.

According to this embodiment, the unit panels 222C of the primary main panel 220C may be connected by the double tongues 250C, and the unit panels 422C of the secondary main panel 420C may be connected by a single tongue (not illustrated).

FIGS. 29 and 30 illustrate structures of the double tongues 250C and 450C.

In addition, a distance between the neighboring double tongues 250C of the primary barrier 200C may be smaller than a distance between the double tongues 450C of the secondary barrier 400C. The double tongues 250C of the primary barrier 200C and the double tongues 450C of the secondary barriers 400C may alternate with each other. When the double tongues 250C of the primary barrier 200C and the double tongues 450C of the secondary barriers 400C are arranged alternately with each other, welded connection parts thereof may also alternate with each other, so that the welded parts may be prevented from being damaged by leakage.

In addition, when the distance between neighboring double tongues 250C of the primary barrier 200C is smaller than the distance between the double tongues 450C of the secondary barrier 400C, contractive displacement of the primary barrier 200C directly contacting the extremely low temperature substance may be sufficiently absorbed.

In addition, as illustrated in FIGS. 25 and 26, the primary insulated wall 300C of the third cargo tank wall C may include an upper plywood board 340C, a lower plywood board 350C and an insulation plate 310C and be provided between the primary barrier 200C and the secondary barrier 400C of the third cargo tank wall C. Both sides of the primary insulated wall 300C may be connected to the primary insulated wall 300A of the first cargo tank wall A.

The upper plywood board 340C may be welded to the flanges 223C fixed on the primary barrier 200C. by the double tongues 250C inserted into the upper plywood board 340C.

The insulation plate 310C may be provided between the upper plywood board 340C and the lower plywood board 350C to be described below. The insulation material 330C used to form the insulation plate 310C may include medium-density polyurethane foam having a density of approximately 130 kg/m$^3$. Alternatively, the insulation material 330C may include low-density polyurethane foam having a density of 45 kg/m$^3$ or less as well as the medium-density polyurethane foam having a density of approximately 130 kg/m$^3$.

The lower plywood board 350C may be provided between the insulation plate 310C and the secondary barrier 400C.

As illustrated in FIGS. 27 and 28, the secondary insulated wall 500C of the third cargo tank wall C may include an upper plywood board 540C, an insulation plate 510C and a lower plywood board 550C and be provided between the secondary barrier 400C of the third cargo tank wall C and the hull shell 100. Both sides of the secondary insulated wall 500C may be connected to the secondary insulated wall 500A of the first cargo tank wall A.

The upper plywood board 540C may be welded to the flanges 423C fixed on the secondary barrier 400C by the double tongues 450C inserted into the upper plywood board 540C. The insulation plate 510C may be provided between the upper plywood board 540C and the lower plywood board 550C to be described below. An insulation material 530C forming the insulation plate 510C may include medium-density polyurethane foam having a density of 130 kg/m$^3$.

The lower plywood board 550C may be provided between the insulation plate 510C and the secondary barrier 400C.

FIG. 29 is an enlarged front view illustrating a double tongue according to an embodiment of the present invention. FIG. 30 is an enlarged perspective view illustrating a double tongue according to an embodiment of the present invention.

As described above in connection with the primary main panel 220 and the secondary main panel 420 of the first, second and third cargo tank walls A, B and C, the double tongues 250 and 450 according to this embodiment may be used to couple the flanges 223 and 423 of the main panels 220 and 420 to each other and have an inverted T shape so that lower portions of the double tongues 250 and 450 may be bent in a direction away from the flanges 223 and 423, respectively.

Each of the double tongues 250 and 450 may have a double structure formed by combining a left tongue (not denoted) whose lower portion is bent to the left and a right tongue (not denoted) whose lower portion is bent to the right side on the basis of a point where each of the flanges 223 and 423 is coupled. The left and right tongues may have the same height. The lower portions of the left and right tongues that are bent and extended to the left and right may have the same length. In other words, the double tongues 250 and 450 may have vertically symmetrical shapes, so that the flanges 223 and 423 may be evenly welded.

The bent and extended end portions may be fixed to the upper plywood boards 340 and 540. Openings (not illustrated) may be provided on the upper plywood boards 340 and 540 so that the end portions of the double tongues 250 and 450 may be inserted into the openings, respectively.

The double tongues 250 and 450 may extend higher than the flanges 223 and 423, respectively. A plurality of flow holes (not illustrated) for the flow of the extremely low temperature substance may be formed in portions of the double tongues 250 and 450 which are exposed above top ends of the flanges 233 and 423, respectively.

In this embodiment, since the double tongues 250 and 450 have a double structure and a symmetrical shape, bonding strength between the flanges 223 and 423 may be improved and bonding strength between the upper plywood boards 340 and 540 and the main panels 220 and 420 may also be improved. Therefore, the double tongues 250 and 450 may increase strength of insulation structures.

As described above, in this embodiment, since the first cargo tank wall A having the primary corrugated panel 210A is applied to the corner line 6 constituting the cargo tank 1, cracks generated by contraction may be prevented, and impact caused by liquefied gas sloshing may be easily absorbed to prevent defects from occurring in the cargo tank 1. Since the auxiliary corrugations 230A, 230B and 230C are formed on the primary barriers 200A, 200B and 200C of the first, second and third cargo tank walls A, B and C, respectively, damage caused by contraction may be prevented and impact caused by liquefied gas sloshing may be more easily absorbed. In addition, since the first, second and third cargo tank walls A, B and C having different structures are selectively applicable to respective parts of the cargo tank 1 where different sloshing phenomena occur, the reliability of the cargo tank may be improved.

In addition, since a high-value material is used in a portion of the first cargo tank wall A applied to a portion of the cargo tank 1, and a relatively low-value material is used for the second or third cargo tank wall B or C applied to the most part of the cargo tank 1, manufacturing costs of the cargo tank 1 may be significantly reduced.

In addition, since the first, second and third cargo tank walls A, B and C are separately manufactured and united into the cargo tank 1, the cargo tank 1 may be manufactured and mounted separately and construction duration may be reduced.

According to an embodiment of the present invention, since first to third cargo tank walls having different structures are selectively applied to respective parts of a cargo tank where different liquefied gas sloshing phenomena occur, so that reliability of the cargo tank for an extremely low temperature substance carrier may be improved.

In addition, a first cargo tank wall having a barrier in which a curved type and a flat type are integrated may be formed at a side corner line of a cargo tank, and a second or third cargo tank wall including a flat type barrier may be bonded to the first cargo tank wall at other parts of the cargo tank, so that the cargo tank may be manufactured and mounted separately and construction duration may be reduced.

In addition, auxiliary corrugations may be formed on primary barriers of the first to third cargo tank walls, so that damage caused by contraction may be prevented and impact caused by liquefied gas sloshing may be reduced.

In addition, a tongue for connecting unit panels of a flat type barrier may have a double structure, so that bonding strength of the barrier may be improved.

In addition, primary and secondary corrugated panels of first and second barriers of a first cargo tank wall provided at a part which is most affected by liquefied gas sloshing may be formed of invar, and first and second main panels of primary and secondary barriers of first to third cargo tank walls may be formed of stainless steel, so that material cost for the barriers may be reduced and thermal contraction may be smoothly absorbed.

What is claimed is:

1. A cargo tank for an extremely low temperature substance carrier, the cargo tank comprising:

a primary barrier including a primary corrugated panel having a corrugated portion formed by a plurality of continuous corrugated cross-sections and a primary main panel connected to the primary corrugated panel;

a secondary barrier including a secondary corrugated panel having a corrugated portion formed by a plurality of continuous corrugated cross-sections and a secondary main panel connected to the secondary corrugated panel;

a primary insulated wall provided between the primary barrier and the secondary barrier and including a depression receiving the corrugated portion of the secondary corrugated panel; and a secondary insulated wall provided between the secondary barrier and a body shell, wherein the primary insulated wall comprises:

an upper plywood board provided under the primary barrier;

an upper glass fiber reinforced epoxy composite provided under the upper plywood board;

a lower glass fiber reinforced epoxy composite provided on the secondary barrier; and an insulation plate provided between the upper glass fiber reinforced epoxy composite and the lower glass fiber reinforced epoxy composite.

2. The cargo tank of claim 1, wherein the insulation plate includes an insulation material formed of high-density polyurethane foam having a density of 200 kg/m$^3$ or more.

3. The cargo tank of claim 1, wherein the upper glass fiber reinforced epoxy composite is a flat panel, and the lower glass fiber reinforced epoxy composite is a flat panel having the depression formed therein.

4. The cargo tank of claim 1, wherein the primary insulated wall includes a depression receiving the corrugated portion of the secondary corrugated panel.

5. The cargo tank of claim 4, wherein the depression has a trapezoidal cross-section having a depth and width greater than a height and width of the corrugated portion of the secondary corrugated panel.

6. The cargo tank of claim 1, wherein the secondary insulated wall comprises:

an upper plywood board provided under the secondary barrier;

a lower plywood board provided on the body shell; and an insulation plate provided between the upper plywood board and the lower plywood board.

7. The cargo tank of claim 6, wherein the insulation plate includes an insulation material formed of high-density polyurethane foam having a density of 200 kg/m$^3$ or more.

8. The cargo tank of claim 1, wherein each of the primary corrugated panel and the secondary corrugated panel includes a corner piece extending from the corrugated portion.

9. The cargo tank of claim 8, wherein each of the primary corrugated panel and the secondary corrugated panel includes invar or stainless steel.

10. The cargo tank of claim 1, wherein each of the primary main panel and the secondary main panel is formed by connecting a plurality of insert panels including flanges, a distance between the flanges provided on the plurality of insert panels of the primary main panel is smaller than a distance between the flanges provided on the insert panels of the secondary main panel, and the flanges of the primary main panel and the flanges of the secondary main panel are arranged alternately with each other.

11. The cargo tank of claim 10, wherein each of the primary main panel and the secondary main panel includes invar or stainless steel.

12. The cargo tank of claim 1, wherein the corrugated portion of each of the primary corrugated panel and the secondary corrugated panel includes a plurality of parallel, continuous corrugated cross-sections formed along a corner line of the cargo tank, and corrugations of the corrugated portion of the secondary corrugated panel have a smaller depth and a greater pitch than corrugations of the corrugated portion of the primary corrugated panel.

13. The cargo tank of claim 1, wherein the corrugated portion of the primary corrugated panel and/or the corrugated portion of the secondary corrugated panel absorbs contraction deformation caused by temperature of an extremely low temperature substance and absorbs sloshing impact exerted on a corner line during liquefied gas sloshing.

* * * * *